US011053942B2

(12) United States Patent
Hamada et al.

(10) Patent No.: US 11,053,942 B2
(45) Date of Patent: Jul. 6, 2021

(54) SCREW COMPRESSOR

(71) Applicant: Kobe Steel, Ltd., Hyogo (JP)

(72) Inventors: Katsunori Hamada, Hyogo (JP); Noboru Tsuboi, Hyogo (JP); Hajime Nakamura, Hyogo (JP)

(73) Assignee: Kobe Steel, Ltd., Hyogo (JP)

( * ) Notice: Subject to any disclaimer, the term of this patent is extended or adjusted under 35 U.S.C. 154(b) by 208 days.

(21) Appl. No.: 16/070,855

(22) PCT Filed: Mar. 3, 2017

(86) PCT No.: PCT/JP2017/008478
§ 371 (c)(1),
(2) Date: Jul. 18, 2018

(87) PCT Pub. No.: WO2017/154771
PCT Pub. Date: Sep. 14, 2017

(65) Prior Publication Data

US 2019/0063438 A1 Feb. 28, 2019

(30) Foreign Application Priority Data

Mar. 8, 2016 (JP) ..... JP2016-044876

(51) Int. Cl.
*F04C 29/04* (2006.01)
*F04C 18/16* (2006.01)
(Continued)

(52) U.S. Cl.
CPC ..... *F04C 29/04* (2013.01); *F04C 18/16* (2013.01); *F04C 29/0085* (2013.01); *F04C 29/023* (2013.01); *F04C 29/0071* (2013.01)

(58) Field of Classification Search
CPC ..... F04C 29/04; F04C 29/02; F04C 29/023; F04C 29/042; F04C 29/045; F04C 29/047;
(Continued)

(56) References Cited

U.S. PATENT DOCUMENTS 3,790,309 A * 2/1974 Volz ..... H02K 5/12 417/368
6,382,930 B1 5/2002 Bahnen et al.
(Continued)

FOREIGN PATENT DOCUMENTS

CN 101010516 A 8/2007
CN 103987553 A 8/2014
(Continued)

OTHER PUBLICATIONS

JPS54154811 translation (Year: 1979).*
JP2008303781 translation (Year: 2008).*

*Primary Examiner* — Devon C Kramer
*Assistant Examiner* — David N Brandt
(74) *Attorney, Agent, or Firm* — Studebaker & Brackett PC

(57) ABSTRACT

A screw compressor is provided with: a compressor body in which a screw rotor is accommodated in a rotor casing; a motor in which a rotator and a stator are accommodated in a motor chamber, the motor for rotationally driving a rotor shaft through use of a motor shaft; axial liquid supplying parts, provided on an anti-rotor side of the motor shaft; a motor shaft cooling part which is a cavity extending in the axial direction inside the motor shaft, the motor shaft cooling part for cooling the motor shaft by circulating a cooling liquid through the inside of the cavity thereof; and a liquid outlet part positioned on a rotor side of the motor shaft or a motor side of the rotor shaft and fluidically connected to the motor shaft cooling part so as to extend
(Continued)

radially inward from an outlet opening formed in an outer surface of the motor shaft or the rotor shaft.

13 Claims, 8 Drawing Sheets

(51) Int. Cl.
*F04C 29/02* (2006.01)
*F04C 29/00* (2006.01)

(58) Field of Classification Search
CPC F04C 2240/603; F04C 18/16; F04B 39/0238; F04B 39/0246
See application file for complete search history.

(56) References Cited

U.S. PATENT DOCUMENTS 6,544,020 B1 * 4/2003 Bahnen ..... F04C 18/16 418/88
2004/0086396 A1 5/2004 De Smedt et al.
2008/0031761 A1 2/2008 North
2011/0174009 A1 * 7/2011 Iizuka ..... F04D 29/057 62/305
2013/0014537 A1 * 1/2013 Fujisawa ..... F04C 29/04 62/468
2013/0213043 A1 8/2013 Kasuya et al.
2014/0326105 A1 11/2014 Kasuya et al.
2014/0331945 A1 11/2014 Kasuya et al.
2018/0223852 A1 * 8/2018 Mlsna ..... F04C 29/023

FOREIGN PATENT DOCUMENTS

JP S54-154811 A 12/1979
JP S54154811 * 12/1979 ..... F04C 23/008
JP S60-255038 A 12/1985
JP H09-154257 A 6/1997
JP 2000-179486 A 6/2000
JP 2000-209815 A 7/2000
JP 2001-227489 A 8/2001
JP 2004-343857 A 12/2004
JP 2008303781 * 2/2008 ..... F04C 18/16
JP 2008303781 * 8/2008 ..... F04C 18/16

* cited by examiner

SCREW COMPRESSOR

TECHNICAL FIELD

The present invention relates to screw compressors and, in particular, to a screw compressor having a cooling structure for cooling a motor arranged to rotationally drive a screw rotor.

BACKGROUND ART

In a screw compressor, a screw rotor is rotationally driven by a motor. When the motor is rotationally driven at high speed, electrical loss such as so-called iron loss (hysteresis loss and/or eddy current loss) and/or copper loss (wire-wound resistor-induced loss) causes the motor to get heated.

A cooling jacket is provided on the outer peripheral portion of a motor casing to cool the heated motor. Coolant flows through the cooling jacket to exchange heat with and thereby cool the motor.

In such a screw compressor with the motor rotating at high speed, the smaller the size of the motor, the smaller the size of the cooling jacket becomes provided on the outer peripheral portion of the motor casing. Cooling only through such a small-sized cooling jacket cannot cool the motor sufficiently, resulting in that the temperature at the surface of the stator coil and the rotor increases to have a problem with the motor. There has hence been proposed a liquid-cooled motor having a double cooling structure to efficiently cool a motor stator (see Patent Document 1).

CITATION LIST

Patent Document

Patent Document 1: JP 2004-343857 A

SUMMARY OF THE INVENTION

Technical Problem

In the liquid-cooled motor of Patent Document 1, the double cooling structure includes a cooling jacket for cooling the outside portion of a motor casing and a coolant passage formed on the inner peripheral surface of the motor casing to cool the outer peripheral portion of the motor stator. The double cooling structure cools the motor stator in contact with the inner peripheral surface of the motor casing.

Incidentally, the motor stator is arranged in a manner spaced from the rotor with a small air gap therebetween. When the stator gets heated, the generated heat transfers through the small air gap to the rotor to further increase the temperature of the rotor. Since the liquid-cooled motor of Patent Document 1 has a structure in which the motor stator is cooled, the rotor, which is positioned inside the motor stator, cannot be cooled sufficiently.

It is hence a technical problem to be solved by the invention to provide a screw compressor in which a stator and a rotor of a motor for rotationally driving a screw rotor can be cooled effectively.

Solution to Problem

In order to solve the foregoing technical problem, the present invention provides the following screw compressor.

That is, the screw compressor is characterized by including a compressor body in which a screw rotor is accommodated in a rotor casing; a motor in which a rotor and a stator are accommodated in a motor chamber of a motor casing, the motor arranged to rotationally drive a rotor shaft of the screw rotor through a motor shaft fixed to the rotor; a shaft liquid supplying part provided on an anti-rotor side of the motor shaft to supply coolant; a motor shaft cooling part which is a cavity extending in the axial direction within the motor shaft, the motor shaft cooling part arranged to cool the motor shaft with coolant supplied through the shaft liquid supplying part flowing through the cavity; and a liquid outlet part positioned on a rotor side of the motor shaft or a motor side of the rotor shaft and extending radially inward from an outlet opening formed in an outer surface of the motor shaft or the rotor shaft to be connected fluidically with the motor shaft cooling part.

Advantageous Effect of the Invention

In accordance with the arrangement above, coolant flowing through the motor shaft cooling part cools the motor shaft. Cooling from within the motor shaft allows the rotor fixed to the motor shaft to be cooled circumferentially from the inner peripheral side (motor shaft side). At the same time, coolant outlet through the outlet opening, which moves circumferentially with the rotation of the motor shaft, into the motor chamber allows the stator to be cooled circumferentially within the motor chamber. The stator and the rotor of the motor for rotationally driving the screw rotor are thus cooled circumferentially from within the motor, whereby the motor can be cooled effectively.

DESCRIPTION OF EMBODIMENTS

First Embodiment

A screw compressor 1 according to a first embodiment of the present invention will first be described with reference to FIGS. 1 to 5. It is noted that the terms "rotor side" and "anti-rotor side" as used herein mean "relatively the same side as that of a screw rotor" and "relatively the opposite side to that of a screw rotor", respectively. The terms "motor side" and "anti-motor side" also mean "relatively the same side as that of a motor" and "relatively the opposite side to that of a motor", respectively.

Figure 1:
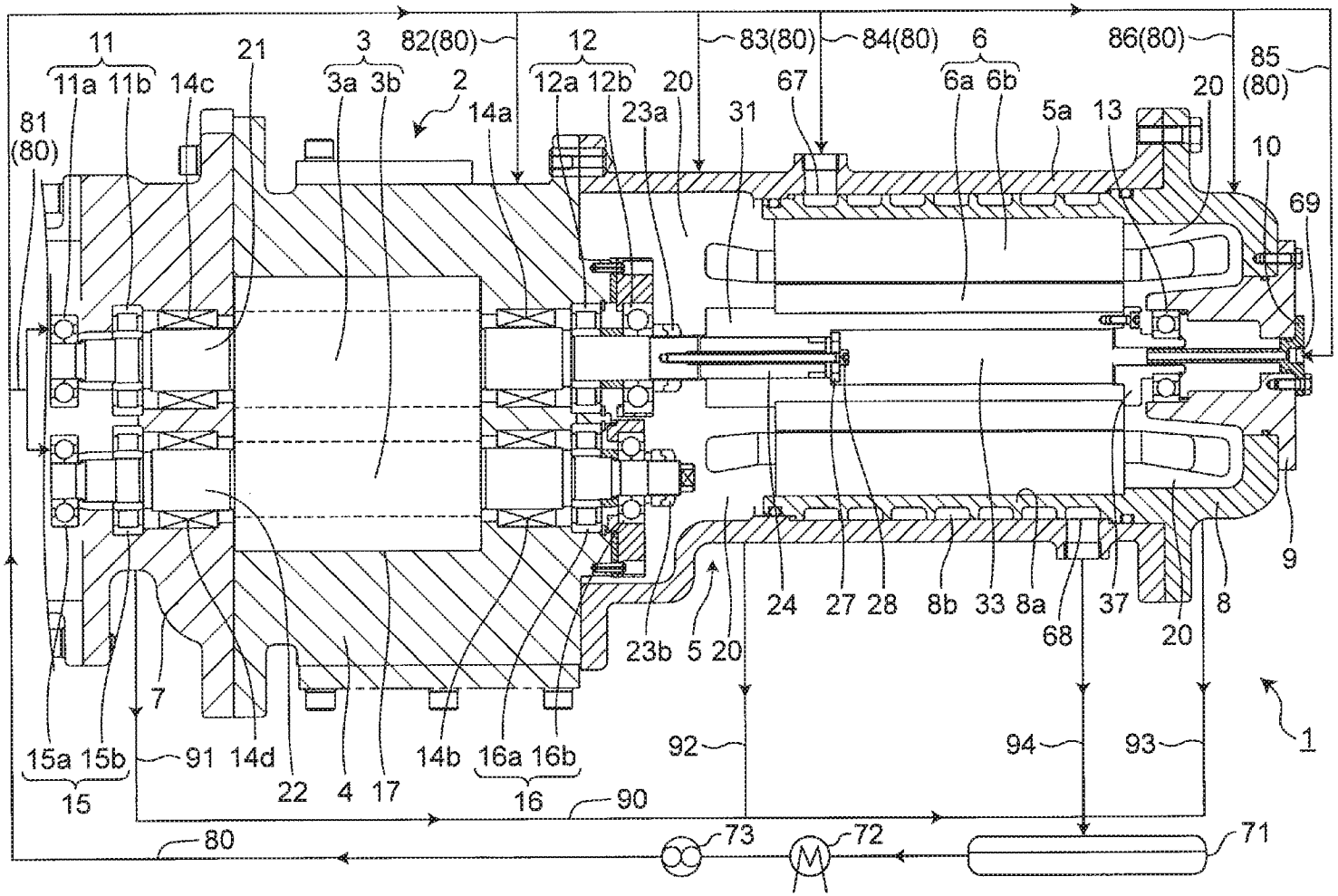
FIG. 1 is a horizontal cross-sectional view conceptually showing a screw compressor according to a first embodiment of the present invention.

The screw compressor 1 shown in FIG. 1 is an oil-free screw compressor. A pair of screw rotors 3 consisting of a male rotor 3*a* and a female rotor 3*b* that are engaged with each other without oil supply are accommodated in a rotor chamber 17 formed in a rotor casing 4 of a compressor body 2. A bearing casing 7 is attached to a suction-side end of the rotor casing 4. A motor casing 5 of a motor 6 is attached to a discharge-side end of the rotor casing 4. The motor 6 has a rotor 6*a*, a stator 6*b*, and the motor casing 5. The motor casing 5 includes a motor casing body 5*a*, a cooling jacket 8, and a cover 9. The rotor 6*a* and the stator 6*b* are accommodated in the motor casing body 5*a*. An anti-rotor side end portion of the motor casing 5 is closed with the cover 9.

A gas discharge port not shown is formed on the motor 6 side of the rotor casing 4, while a gas suction port not shown is formed on the side of the rotor casing 4 opposite to the motor 6. Timing gears (not shown) engaged with each other are attached to the axial ends of the male rotor 3*a* and the female rotor 3*b* opposite to the motor 6. The male rotor 3*a* is usually driven rotationally by the motor 6. When a motor shaft 31 of the motor 6 is driven rotationally, a male rotor shaft 21 of the male rotor 3*a* rotates and, via the timing gears, a female rotor shaft 22 of the female rotor 3*b* rotates in a manner synchronized with the male rotor shaft 21.

The motor 6 is controlled by an inverter not shown with respect to its rotating speed and is operated to rotate at a speed of higher than 20000 rpm, for example. The rotor 6*a* of the motor 6 is fixed to an outer peripheral portion of the motor shaft 31 and the stator 6*b* is arranged in a manner spaced outward from the rotor 6*a*. An air gap 6*g* is formed between the rotor 6*a* and the stator 6*b*. In the motor casing 5, the cooling jacket 8 is disposed between the stator 6*b* and the motor casing body 5*a* to be in close contact with the stator 6*b*.

Figure 3:
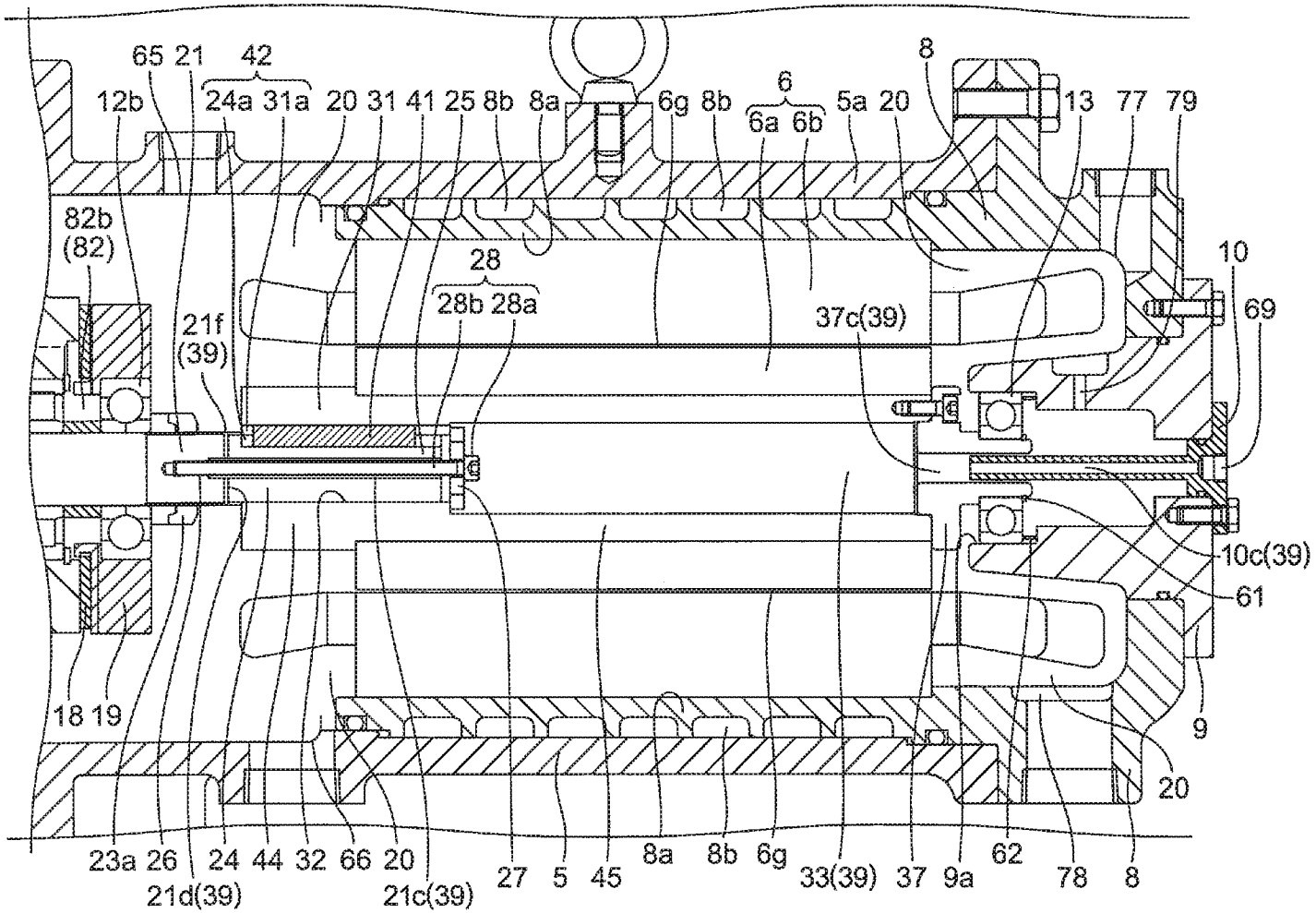
FIG. 3 is a partial cross-sectional view of a motor chamber in the screw compressor shown in FIG. 2.

The motor shaft 31 has multiple shaft portions having their respective different diameters that decrease from the screw rotors 3 toward a motor bearing part 13. As shown in FIG. 3, the motor shaft 31 is composed of, for example, a first shaft portion 44 and a second shaft portion 45. The first shaft portion 44 with a larger diameter is latched on a side end face of the rotor 6*a*. The rotor 6*a* is fixedly in close contact with the outer peripheral surface of the second shaft portion 45 with a smaller diameter. A connection hole 32 exists in an axially extending manner across the entire first shaft portion 44 and a portion of the second shaft portion 45. A center hole 33 serving as a motor shaft cooling part exists in an axially extending manner across the rest of the second shaft portion 45. A protruding end portion of a bearing support 37 is inserted in the center hole 33 of the motor shaft 31 and fastened using a fixing bolt 38 with a flange portion of the bearing support 37 in contact with a side end face of the second shaft portion 45. This causes the bearing support 37 to be fixed to the motor shaft 31 and one end of the center hole 33 on the motor bearing part 13 side to be closed. The center hole 33 is a cavity extending in the axial direction within the motor shaft 31 to serve as a motor shaft cooling part for cooling the motor shaft 31 with coolant (oil in this embodiment) supplied through a motor shaft liquid supplying member (shaft liquid supplying part) 10 flowing through the center hole 33. The motor shaft cooling part is provided within the motor shaft 31 at the site where the rotor 6*a* is positioned.

The cooling jacket 8 is brought into close contact along the inner surface of the motor casing body 5*a* and fastened using a bolt with their respective flange portions in contact with each other to thereby be fixed to the motor casing body 5*a*. A cooling passage 8*b* for coolant (oil in this embodiment) to flow therethrough is formed in a cooling jacket part 8*a* of the cooling jacket 8. Packing positioned on each axial outside of the cooling passage 8*b* and provided on the cooling jacket part 8*a* prevents leakage from the cooling passage 8*b* into the motor casing body 5*a*.

The male rotor shaft 21 of the screw rotor 3 and the motor shaft 31 of the motor 6 are formed separately, and the male rotor shaft 21 and the motor shaft 31 are integrally connected using a key 41 (coupling member) to exist in a horizontally (laterally) and coaxially extending manner. As shown in FIG. 1, an anti-motor 6 side of the male rotor shaft 21 is supported on the bearing casing 7 by a rotor bearing part 11. A motor 6 side of the male rotor shaft 21 is supported on the rotor casing 4 by an intermediate bearing part 12. That is, the male rotor shaft 21 is supported in a double fixed manner by the rotor bearing part 11 and the intermediate bearing part 12. The bearing support 37, which is fixed to an anti-rotor side end portion of the motor shaft 31, is supported on the cover 9 by the motor bearing part 13. The male rotor shaft 21 and the motor shaft 31, which are connected integrally to each other, thus exist in a horizontally (laterally) and coaxially extending manner to be supported at three points (i.e. three-point supported) by the rotor bearing part 11, the intermediate bearing part 12, and the motor bearing part 13. On the other hand, the female rotor shaft 22 of the female rotor 3*b* is supported in a double fixed manner on the bearing casing 7 and the rotor casing 4 by a rotor bearing part 15 and an intermediate bearing part 16.

The rotor bearing part 11 is composed of, for example, a thrust beating (four-point contact ball bearing) 11*a* and a radial bearing (roller bearing) 11*b*. The intermediate bearing part 12 is composed of, for example, a radial bearing (roller bearing) 12*a* provided on the rotor side and a thrust beating (four-point contact ball bearing) 12*b* provided on the motor side. Thus providing the thrust bearing 12*b* on the motor 6 side allows the thrust bearing 12*b* to receive thrust loading even when the rotor shaft 21 may thermally expand to be stretched. An intermediate liquid supplying path 82 (intermediate oil supplying path) for supplying oil therethrough to the intermediate bearing part 12 is also provided between the radial bearing 12*a* and the thrust bearing 12*b*. The motor bearing part 13 is formed by, for example, a radial bearing (deep groove ball bearing).

The rotor bearing part 15, which supports the female rotor shaft 22, is also composed of, for example, a thrust beating (four-point contact ball bearing) 15*a* and a radial bearing (roller bearing) 15*b*. The intermediate bearing part 16 is composed of, for example, a radial bearing (roller bearing) 16*a* and a thrust beating (four-point contact ball bearing) 16*b*. Also, the bearing (corresponding to the thrust bearing 12*b* in this embodiment) supporting on the motor 6 side the rotor shaft (here the male rotor shaft 21) to be connected to at least the motor shaft 31 employs an open-formed bearing so that oil flows to lubricate the motor 6. It is noted that while the other bearings each employ an open-formed one in this embodiment, it is only required for the other bearings to appropriately determine whether or not to employ an open-formed bearing in light of loading on the bearing and/or the way of lubrication.

An intermediate shaft sealing part 14*a* is provided in the male rotor shaft 21 between the male rotor 3*a* and the intermediate bearing part 12. A shaft sealing part 14*c* is provided in the male rotor shaft 21 between the rotor bearing part 11 and the male rotor 3*a*. A shaft sealing part 14*b* is provided in the female rotor shaft 22 between the female rotor 3*b* and the intermediate bearing part 16. A shaft sealing part 14*d* is provided in the female rotor shaft 22 between the rotor bearing part 15 and the female rotor 3*b*. The shaft sealing parts 14*a*, 14*b*, 14*c*, 14*d* each include, for example, a viscoseal serving as an oil seal and a mechanical seal serving as an air seal. The viscoseals provided on the bearing side prevent oil from flowing into the rotor chamber 17. The mechanical seals provided on the screw rotor 3 side prevent oil from flowing into the rotor chamber 17 and compressed gas from unnecessarily leaking out of the rotor chamber 17.

As shown in FIG. 3, an inner race of the motor hearing part 13 is positioned in an axially immovable manner by a stopper ring 61 disposed on the bearing support 37. On the other hand, the motor bearing part 13 is clearance fitted into a bearing mounting hole 9*a* of the cover 9. This allows an outer race of the motor bearing part 13 to move in the axial direction. That is, the motor bearing part 13 is assembled into the motor 6 in a manner allowing for axial sliding on the outer race. This arrangement can prevent unreasonable loading on the motor bearing part 13 even when the motor shaft 31 may thermally expand to be stretched.

The cover 9 is mounted on the cooling jacket 8 so as to close the opening of the motor casing 5. A flange portion of the cover 9 is brought into contact with a side end face of the cooling jacket 8 and, in this state, fastened using a bolt so that the cover 9 is fixed to the cooling jacket 8.

The motor shaft 31 of the motor 6 has a diameter greater than that of a connection end portion 24 on the motor 6 side of the screw rotor 3 (male rotor shaft 21 in this embodiment). The connection hole 32 for insertion of the connection end portion 24 therethrough is formed in the larger-diameter motor shaft 31. The center hole 33 with a diameter greater than that of the connection hole 32 is formed in the motor shaft 31. The center hole 33 and the connection hole 32 form a through hole penetrating through the motor shaft 31 in the axial direction, causing the motor shaft 31 to have a hollow structure.

A step is formed at the boundary between the larger-diameter center hole 33 and the smaller-diameter connection hole 32. The step of the through hole penetrating through the motor shaft 31 allows a fastening flange 27 to be inserted freely through the center hole 33, but causes the connection hole 32 to be dead-ended. The fastening flange 27 has a screw insertion hole and multiple flange communication holes 27*a*. The multiple flange communication holes 27*a* provide communication between the center hole 33 and a liquid guide hole 21*c*.

Figure 5:
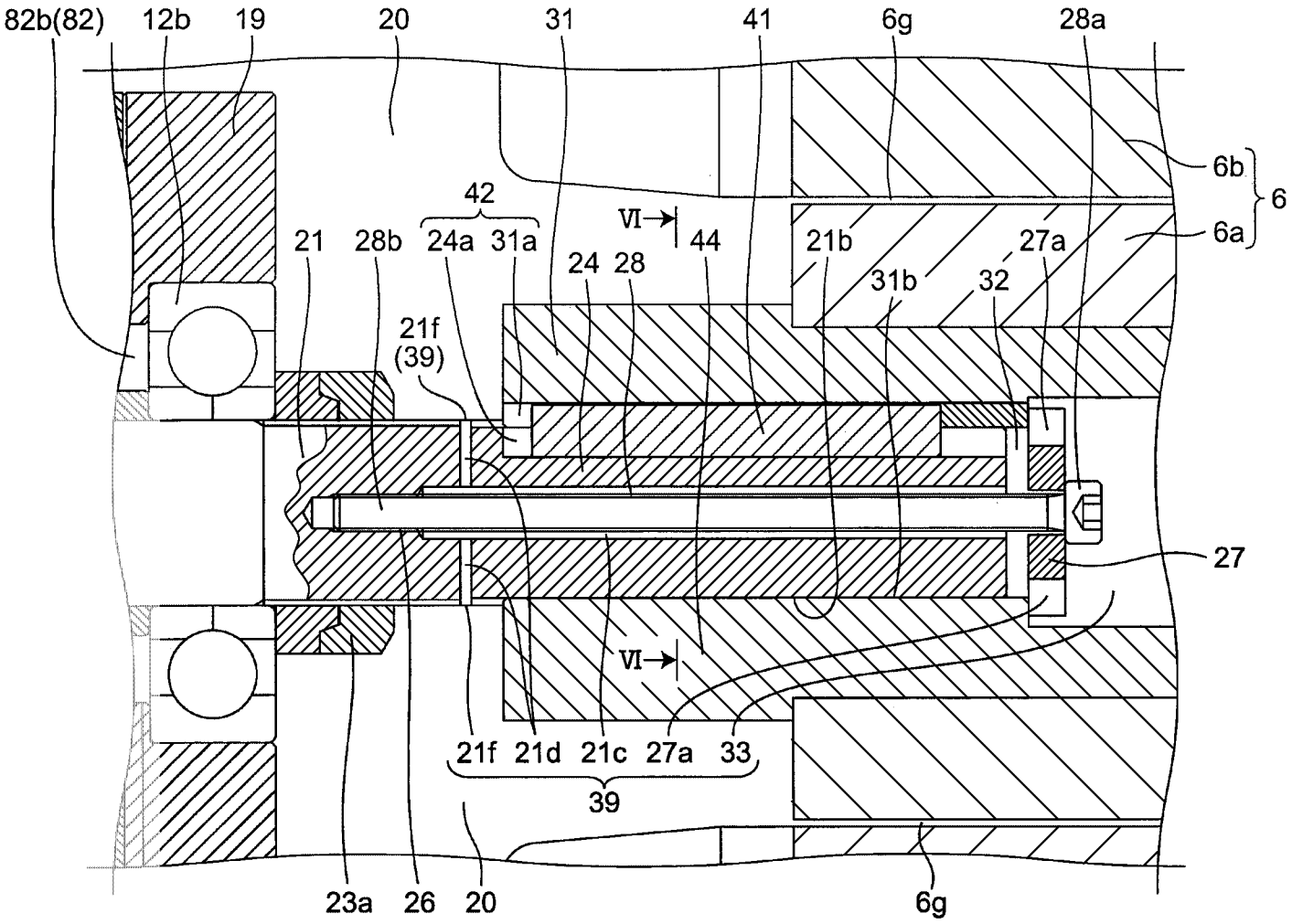
FIG. 5 is an enlarged cross-sectional view around an intermediate bearing part in the screw compressor shown in FIG. 3.

As shown in FIG. 5, a recessed second key groove 31*a* with a rectangular cross-section, for example, is formed in the inner peripheral surface 31*b* of the connection hole 32 provided in the motor shaft 31. A recessed first key groove 24*a* with a rectangular cross-section, for example, is formed in the outer peripheral surface 21*b* of the connection end portion 24 provided in the male rotor shaft 21. The first key groove 24*a* and the second key groove 31*a* form a key groove 42 with a rectangular cross-section in the axial direction. In the state where the connection end portion 24 is inserted in the connection hole 32, the key 41 with a rectangular cross-section is arranged in a manner interposed between the inner peripheral surface 31*b* of the connection hole 32 of the motor shaft 31 and the outer peripheral surface 21*b* of the connection end portion 24 of the male rotor shaft 21. The key 41 is fitted into the key groove 42. The key 41 thus serves as a coupling member that integrally couples the motor shaft 31 and the male rotor shaft 21.

A fastening part is provided within the connection end portion 24. The fastening part includes the liquid guide hole 21*c* and a screw hole 26 extending in the axial direction from an end face of the connection end portion 24. The liquid guide hole 21*c* is a cavity provided on the motor 6 side of the rotor shaft 21 and extending in the axial direction within the rotor shaft 21, the cavity used for connection between the rotor shaft 21 and the motor shaft 31 and serving as a rotor shaft cooling part. The diameter of the liquid guide hole 21*c* is greater than that of the screw hole 26. A cavity forming a flow path between the liquid guide hole 21*c* and the flange communication hole 27*a* is also provided between the connection end portion 24 and the fastening flange 27. Coolant (oil in this embodiment) passing through the flange communication hole 27*a* can therefore flow through an annular gap formed between the liquid guide hole 21*c* and a fastening bolt 28. Multiple liquid outlet holes 21*d* with one end in communication with the interior of the motor chamber 20 to extend radially inward (e.g. orthogonally toward the shaft center) are formed in the rotor shaft (here the male rotor shaft 21) between the rotor side end face of the rotor 6*a* and a bearing support member 19. That is, multiple outlet openings 21*f* opened into the motor chamber 20 are formed in the outer surface of the rotor shaft 21. The multiple liquid outlet holes 21*d* form a liquid outlet part that fluidically connects each outlet opening 21*f* and the liquid guide hole 21*c* as well as the motor chamber 20. Communication through the center hole 33, the multiple flange communication holes 27*a*, the liquid guide hole 21*c*, and the multiple liquid outlet holes 21*d* forms a portion of a motor shaft communication part 39.

The multiple liquid outlet holes 21*d* extending radially inward are only required to be positioned between the rotor side end face of the rotor 6*a* and the bearing support member 19 to be in communication with the multiple outlet openings 21*f* opened into the motor chamber 20. That is, the liquid outlet holes 21*d* may be formed across the rotor shaft 21 and the motor shaft 31. In this case, the outlet openings are formed in the outer surface of the motor shaft 31. The liquid outlet holes 21*d* may extend in an inclined manner toward the rotor 6*a* and/or the stator 6*b* of the motor so that outlet coolant (oil in this embodiment) is likely to come into contact with the rotor 6*a* and/or the stator 6*b* of the motor. Alternatively, the liquid outlet holes 21*d* may extend such that the outlet openings 21*f* are positioned in a manner opposed to the inner peripheral side of a wire-wound portion of the stator 6*b*. This allows the wire-wound portion of the stator 6*b* to be cooled effectively.

A screw portion 28*b* of the fastening bolt 28 is threadably mounted into the screw hole 26 of the fastening part. The fastening bolt 28 as a fastening member is inserted through the screw insertion hole of the fastening flange 27. When the fastening flange 27 is inserted in the center hole 33 and engaged at the step of the through hole and, in this state, the fastening bolt 28 is fastened, the connection end portion 24 of the male rotor shaft 21 is pulled closer to the motor bearing part 13 and thereby a head portion 28*a* of the fastening bolt 28 is latched on the fastening flange 27. As a result, the fastening bolt 28 fastens the motor shaft 31 and the male rotor shaft 21. Thus, the motor shaft 31 and the male rotor shaft 21, when connected integrally through the key 41, are fastened by the fastening bolt 28.

The motor shaft 31 and the male rotor shaft 21, which are connected integrally by the key 41 serving as a coupling member and fastened by the fastening bolt 28 serving as a fastening member, serve as a single shaft body. In the fitting structure thus employing the key 41, the transmission torque cannot be influenced by the coolant. It is therefore possible to transmit torque reliably between the motor shaft 31 and the male rotor shaft 21 even when coolant may travel down the male rotor shaft 21 existing in a horizontally extending manner into the connection hole 32.

Upon this, the head portion 28*a* of the fastening bolt 28 is positioned within the center hole 33, which is formed in a manner penetrating through the motor shaft 31 in the axial direction. Particularly, the head portion 28*a* is immersed within the center hole 33 of the motor shaft 31 so as to be positioned in the vicinity of an axial end face of the male rotor shaft 21. That is, the fastening bolt 28 is configured to have a small axial length. With this arrangement, the fastening bolt 28 is less likely to be influenced by thermal expansion and thereby can be fastened reliably. It is noted that the connection end portion 24 of the male rotor shaft 21 and the connection hole 32 and the center hole 33 of the motor shaft 31 exist in a coaxially extending manner.

As shown in FIG. 1, the radial bearing 12*a* of the intermediate bearing part 12 is attached to the motor 6 side of the rotor casing 4. The inner race of the radial bearing 12*a* is positioned fixedly with respect to the male rotor shaft 21, while the outer race of the radial bearing 12*a* is positioned by the stopper ring fixedly with respect to the rotor casing 4. The bearing support member 19 is attached to the motor 6 side of the rotor casing 4 via a spacer 18. Fastened using a bolt, the bearing support member 19 and the spacer 18 are fixed to the motor 6 side of the rotor casing 4. The inner race of the thrust bearing 12*b* is positioned by a locking nut 23*a* fixedly with respect to the male rotor shaft 21.

Similarly, the radial bearing 16*a* of the intermediate bearing part 16 is attached to the motor 6 side of the rotor casing 4. The inner race of the radial bearing 16*a* is positioned fixedly with respect to the female rotor shaft 22, while the outer ring of the radial bearing 16*a* is positioned by the stopper ring fixedly with respect to the rotor casing 4. The inner race of the thrust bearing 16*b* is positioned by a locking nut 23*b* fixedly with respect to the female rotor shaft 22.

It is noted that the inner races and the outer races forming the bearings and rolling elements are usually composed of steel material to have electrical conductivity. This causes a high-frequency current from an inverter circuit of the motor 6 to flow through the intermediate bearing part 12 and the motor bearing part 13 on which the motor shaft 31 of the motor 6 is supported, resulting in an electrical corrosion phenomenon in which an axial voltage may occur between the outer race and the inner race of the intermediate bearing part 12 and the motor bearing part 13 to damage the bearings. To address this, the intermediate bearing part 12 and the motor bearing part 13 are insulated electrically. Electrical insulation of a bearing means, for example, that the rolling element of the bearing is composed of inorganic insulating material such as ceramics or that the outer surface of at least one of the inner race and the outer race of the bearing is covered with organic insulating material such as epoxy resin or unsaturated polyester resin. The portion of each support member and/or casing in contact with and thereby supporting the bearings may also be covered with insulating material. Such electrical insulation of the intermediate bearing part 12 and the motor bearing part 13 can make an electrical corrosion phenomenon less likely to occur in which a high-frequency current from the inverter circuit of the motor 6 may damage the bearing parts 12, 13.

(Oil-Based Motor Cooling Structure)

Next will be described a cooling structure according to the first embodiment above in which the motor 6, which rotationally drives the screw rotor 3 at high speed, is cooled with coolant oil.

Figure 2:
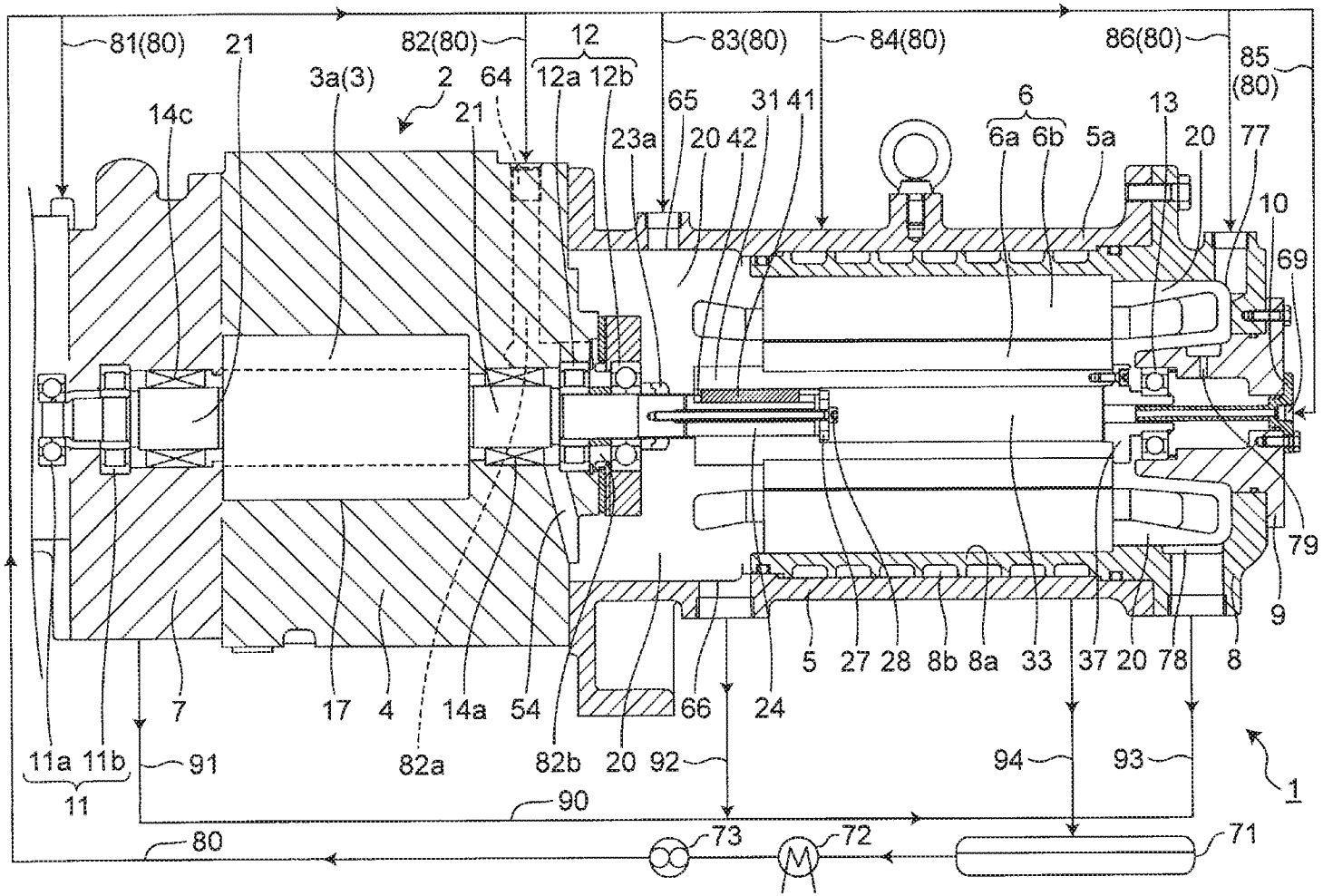
FIG. 2 is a vertical cross-sectional view of the screw compressor shown in FIG. 1.

As shown in FIG. 2, an intermediate liquid supplying port (intermediate oil supplying port) 64 in communication with the intermediate liquid supplying path (intermediate oil supplying path) 82 is formed in an upper portion of the rotor casing 4. An intermediate liquid supplying hole (intermediate oil supplying hole) 82*a* extending from the intermediate liquid supplying port 64 to the intermediate bearing part 12 is formed within the rotor casing 4. The radial bearing 12*a* and the thrust bearing 12*b* are arranged in a manner spaced by the spacer 18. A communication space 82*b* is formed between the radial bearing 12*a* and the thrust bearing 12*b* spaced from each other. The intermediate liquid supplying hole 82*a* is in communication with the communication space 82*b*. Accordingly, the intermediate liquid supplying path 82 is in communication with the communication space 82*b* via the intermediate liquid supplying hole 82*a* within the rotor casing 4.

Oil supplied into the intermediate liquid supplying path 82 is supplied through the communication space 82*b* to the radial bearing 12*a* and the thrust bearing 12*b* of the intermediate bearing part 12. Oil supplied to the radial bearing 12*a* is used for lubrication and cooling of the radial bearing 12*a*. Oil is controlled by an oil seal of the intermediate shaft sealing part 14*a* not to flow toward the rotor chamber 17. On the other hand, the rotor casing 4 includes an intermediate communication part 54 with one end in communication with a clearance part formed between the radial bearing 12*a* and the intermediate shaft sealing part 14*a*, while the other end in communication with the motor chamber 20. Oil flowing from the radial bearing 12*a* toward the screw rotor 3 is introduced through the intermediate communication part 54 into the motor chamber 20. Oil introduced through the intermediate communication part 54 into the motor chamber 20 is discharged out of the motor chamber 20 through a motor chamber liquid discharging port 66 (motor chamber oil discharging port; hereinafter referred to as liquid discharging port 66) serving as a liquid discharging part on the rotor side of the rotor 6*a* to be recovered into a liquid recovering part 71 (oil recovering part).

Thus including the intermediate communication part 54 allows to prevent oil from flowing over the intermediate shaft sealing part 14*a* into the rotor chamber 17, even if the radial bearing 12*a* may employ an open-formed one. Particularly, in a multi-stage compressor in which multiple motors 6 can be regulated to have their respective different rotating speeds, the screw rotor 3 in a low-pressure stage including the intermediate communication part 54 allows to effectively prevent oil from flowing into the rotor chamber 17 even when the discharge side of the low-pressure stage may have a negative pressure.

Oil supplied to the thrust bearing 12*b* is used for lubrication and cooling of the thrust bearing 12*b*. Oil flowing through and used for lubrication and cooling of the thrust bearing 12*b* is introduced into the motor chamber 20 to cool the outer surface of the motor shaft 31. Oil is atomized by the motor shaft 31 and the rotor 6*a* rotating at high speed within the motor chamber 20 to be oil mist. The misted oil adheres to the rotor 6*a*, the stator 6*b*, and the motor shaft 31 within the motor chamber 20 to contribute to cooling of the motor 6 from within the motor chamber 20.

A motor chamber liquid supplying path 83 (motor chamber oil supplying path; hereinafter referred to as liquid supplying path 83) for supplying oil as coolant therethrough into the motor chamber 20 is provided in an upper portion of the motor casing 5 on the rotor side with respect to the rotor 6*a*. A motor chamber liquid supplying port 65 (motor chamber oil supplying port; hereinafter referred to as liquid supplying port 65) in communication with the liquid supplying path 83 is disposed in an upper portion of the motor chamber 20 on the intermediate bearing part 12 side, that is, in an upper portion of the motor casing 5 on the intermediate bearing part 12 side. The liquid supplying path 83 and the liquid supplying port 65 serve, respectively, as a motor chamber oil supplying path and a motor chamber oil supplying port. The liquid supplying port 65 is provided with a nozzle (not shown) through which oil can flow out in an atomized manner.

Oil supplied into the liquid supplying path 83 is introduced through the nozzle into the motor chamber 20. Oil introduced into the motor chamber 20 adheres to the rotor 6*a*, the stator 6*b*, and the motor shaft 31 within the motor chamber 20 to cool the motor 6.

A motor chamber liquid discharging path 92 (motor chamber oil discharging path; hereinafter referred to as liquid discharging path 92) for discharging coolant oil therethrough from within the motor chamber 20 is provided in a lower portion of the motor casing 5 on the rotor side with respect to the rotor 6*a*. A liquid discharging port 66 in communication with the liquid discharging path 92 is formed in a bottom portion of the motor chamber 20 on the intermediate bearing part 12 side, that is, in a bottom portion of the motor casing 5 on the intermediate bearing part 12 side. The liquid discharging path 92 and the liquid discharging port 66 serve, respectively, as a motor chamber oil discharging path and a motor chamber oil discharging port (liquid discharging part). Oil used for lubrication of the intermediate bearing part 12 and cooling of the motor 6 is collected in the bottom portion of the motor chamber 20 on the intermediate bearing part 12 side and discharged out of the motor chamber 20 through the liquid discharging port 66. The oil is recovered through the liquid discharging path 92 into the liquid recovering part 71.

A motor chamber liquid supplying path 86 (motor chamber oil supplying path; hereinafter referred to as liquid supplying path 86) for supplying oil as coolant therethrough into the motor chamber 20 is provided in an upper portion of the motor casing 5 on the anti-rotor side with respect to the rotor 6*a*. A motor chamber liquid supplying port 77 (motor chamber oil supplying port; hereinafter referred to as liquid supplying port 77) in communication with the liquid supplying path 86 is formed in an upper portion of the motor chamber 20 on the motor bearing part 13 side. That is, the liquid supplying port 77 is formed in an upper portion of the motor casing 5 forming the cooling jacket 8 on the motor bearing part 13 side. The liquid supplying path 86 and the liquid supplying port 77 serve, respectively, as a motor chamber oil supplying path and a motor chamber oil supplying port. The liquid supplying port 77 is opened to cause oil to flow out toward winding of the stator 6*b*. A motor bearing oil supplying hole 79 is formed in an upper portion of the cover 9 positioned below the winding of the stator 6*b*. The motor bearing oil supplying hole 79 has in an upper portion thereof an oil receiving part with an opening area increased in a recessed manner.

Oil supplied into the liquid supplying path 86 is supplied through the liquid supplying port 77 into the motor chamber 20 to cool the winding of the stator 6*b*. Oil flowing below the winding of the stator 6*b* is collected in the oil receiving part and supplied through the motor bearing oil supplying hole 79 to the motor bearing part 13. Oil supplied to the motor bearing part 13 is used for lubrication and cooling of the motor bearing part 13. Oil used for lubrication and cooling of the motor bearing part 13 is introduced into the motor chamber 20.

A motor chamber liquid discharging path 93 (motor chamber oil discharging path; hereinafter referred to as liquid discharging path 93) for discharging coolant oil therethrough from within the motor chamber 20 is provided in a lower portion of the motor casing 5 on the anti-rotor side with respect to the rotor 6*a*. A motor chamber liquid discharging port 78 (motor chamber oil discharging port; hereinafter referred to as liquid discharging port 78) in communication with the liquid discharging path 93 is formed in a bottom portion of the motor chamber 20 on the motor bearing part 13 side. That is, the liquid discharging port 78 is formed in a bottom portion of the motor casing 5 forming the cooling jacket 8 on the motor bearing part 13 side. The liquid discharging path 93 on the anti-rotor side and the liquid discharging port 78 on the anti-rotor side serve, respectively, as a motor chamber oil discharging path and a motor chamber oil discharging port (liquid discharging part). Oil used for lubrication of the motor bearing part 13 and cooling of the winding of the stator 6*b* of the motor 6 is collected in the bottom portion of the motor chamber 20 on the motor bearing part 13 side and discharged out of the motor chamber 20 through the liquid discharging port 78 serving as a liquid discharging part on the anti-rotor side of the rotor 6*a*. The oil is recovered through the liquid discharging path 93 into the liquid recovering part 71.

A bearing liquid supplying path 81 (bearing oil supplying path) for supplying therethrough to the rotor bearing part 11 is provided in an upper portion of the bearing casing 7. A rotor bearing oil supplying port (not shown) in communication with the bearing liquid supplying path 81 is formed in an upper portion of the bearing casing 7 on the rotor bearing part 11 side. A rotor bearing oil supplying hole (not shown) extending from the rotor bearing oil supplying port to the rotor bearing part 11 is formed within the bearing casing 7.

Oil supplied into the bearing oil supplying path 81 is supplied through the rotor bearing oil supplying hole to the rotor bearing part 11. Oil supplied to the rotor bearing part 11 is used for lubrication and cooling of the rotor bearing part 11. Oil used for lubrication and cooling of the rotor bearing part 11 is controlled by an oil seal of the shaft sealing part 14*c* not to flow toward the rotor chamber 17.

A bearing liquid discharging path 91 (bearing oil discharging path) for discharging oil therethrough from the rotor bearing part 11 is provided in a lower portion of the bearing casing 7. A rotor bearing liquid discharging port (rotor bearing oil discharging port; not shown) in communication with the bearing liquid discharging path 91 from the rotor bearing part 11 is formed in a bottom portion of the bearing casing 7. Oil used for lubrication and cooling of the rotor bearing part 11 is discharged out of the bearing casing 7 through the rotor bearing liquid discharging port. The oil is recovered through the bearing liquid discharging path 91 into the liquid recovering part 71.

A jacket liquid supplying path 84 (hereinafter referred to as liquid supplying path 84) for supplying oil as coolant therethrough into the cooling passage 8*b* of the cooling jacket 8 is provided in the motor casing 5. A jacket liquid supplying port 67 (hereinafter referred to as liquid supplying port 67) in communication with the liquid supplying path 84 is formed in the motor casing 5. The liquid supplying port 67 is in communication with the cooling passage 8*b*. Oil supplied into the liquid supplying path 84 is supplied through the liquid supplying port 67 into the cooling passage 8*b* to cool the stator 6*b*.

A jacket liquid discharging path 94 (jacket oil discharging path; hereinafter referred to as liquid discharging path 94) for discharging oil as coolant therethrough out of the cooling jacket 8 is provided in a lower portion of the motor casing 5. A jacket liquid discharging port 68 (hereinafter referred to as liquid discharging port 68) in communication with the liquid discharging path 94 is formed in a lower portion of the motor chamber 5. The downstream side of the cooling passage 8*b* in the cooling jacket 8 is in communication with the liquid discharging path 94 that forms a portion of a liquid discharging path 90 (oil discharging path; hereinafter referred to as liquid discharging path 90). The liquid discharging port 68 is in communication with the cooling passage 8*b*. Oil flowing through the cooling passage 8*b* is discharged out of the motor casing 5 through the liquid discharging port 68. The oil is recovered through the liquid discharging path 94 into the liquid recovering part 71. Accordingly, oil used for lubrication and cooling of the bearing parts 11, 12, 13 may be utilized to flow through the cooling passage 8*b* of the cooling jacket part 8*a* to cool the stator 6*b* of the motor 6.

As shown in FIG. 3, the motor shaft liquid supplying member 10 includes an attachment flange 10*a* and a protruding portion 10*b* and is attached to the opening portion in the lateral side of the cover 9 in an airtight manner. A motor shaft liquid supplying port 69 (hereinafter referred to as shaft liquid supplying port 69) is formed in a central portion of the attachment flange 10*a*. A liquid introduction hole 10*c* is formed within the protruding portion 10*b* that extends in the axial direction. The liquid introduction hole 10*c* is a through hole extending in the axial direction and provides communication between the shaft liquid supplying port 69 and the insertion hole 37*c* of the bearing support 37.

Figure 4:
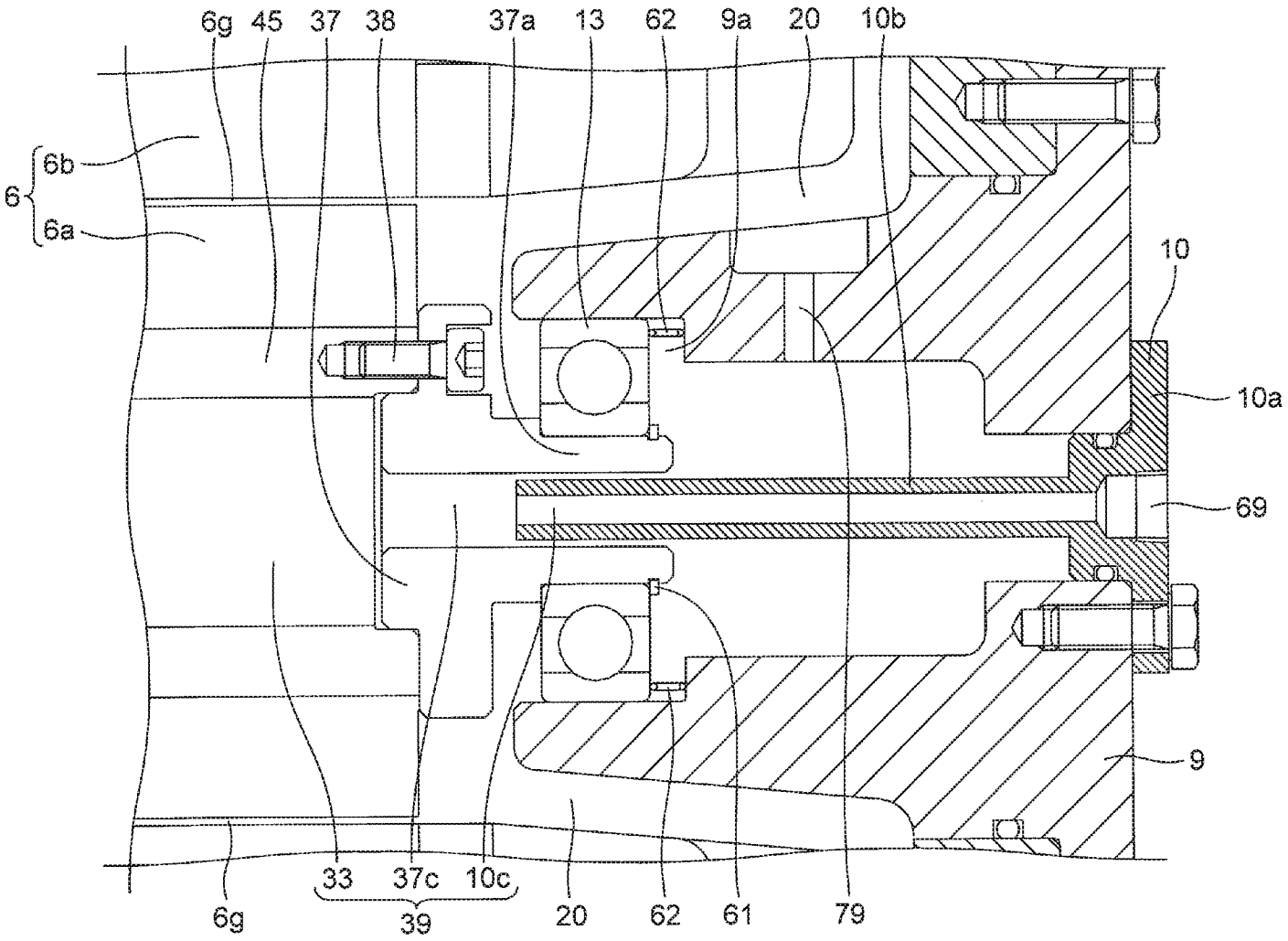
FIG. 4 is an enlarged cross-sectional view around a motor bearing part in the screw compressor shown in FIG. 3.

The insertion hole 37*c* is formed in a central portion of the bearing support 37. The insertion hole 37*c*, having a diameter greater than that of the protruding portion 10*b* of the motor shaft liquid supplying member 10, is a through hole extending in the axial direction through which the protruding portion 10*b* can be inserted via a small gap. The liquid introduction hole 10*c* and the insertion hole 37*c* are arranged coaxially with respect to the center hole 33. A portion of the protruding portion 10*b* is inserted through the insertion hole 37*c* such that an end portion of the protruding portion 10*b* overlaps the insertion hole 37*c* in the axial direction. As shown in FIG. 4, communication through the liquid introduction hole 10*c*, the insertion hole 37*c*, and the center hole 33 forms a portion of the motor shaft communication part 39. The motor shaft liquid supplying member 10 and the bearing support 37 are provided on the anti-rotor side of the motor shaft 31 to serve as a shaft liquid supplying part for supplying to the motor shaft communication part 39 oil serving as coolant supplied from a shaft liquid supplying path 85 (hereinafter referred to as liquid supplying path 85).

Communication through the liquid introduction hole 10*c*, the insertion hole 37*c*, the center hole 33, the multiple flange communication holes 27*a*, the liquid guide hole 21*c*, and the multiple liquid outlet holes 21*d* thus forms the motor shaft communication part 39. With this arrangement, oil supplied through the shaft liquid supplying port 69 in communication with the liquid supplying path 85 flows through the center hole 33, which is formed within the site of the motor shaft 31 where the rotor 6*a* is positioned, to cool the rotor 6*a* circumferentially from inside (interior) thereof. Oil flowing through the center hole 33 cools the motor shaft 31 from inside (within the motor). It is noted that the center hole 33, which is provided in an axially extending manner along the rotor 6*a*, has a diameter greater than that of the insertion hole 37*c*. In this embodiment, the center hole 33 is set to have a surface area per unit length greater than that of the insertion hole 37*c* in the axial direction and have a diameter three times or more that of the insertion hole 37*c*. This allows the center hole 33 to have a larger surface area, that is, a larger heat transfer surface, resulting in an increase in the effect of cooling of the rotor 6*a*.

Oil flowing through the center hole 33 and used for circumferential cooling of the rotor 6*a* of the motor 6 from inside (within the motor) flows into the motor chamber 20 on the rotor side through each outlet opening 21*f* of the multiple liquid outlet holes 21*d* that move in the circumferential direction with the rotation of the motor shaft 31. Oil flowing out through each outlet opening 21*f* adheres circumferentially to the stator 6*b* to cool the stator 6*b* circumferentially from within the motor chamber 20. Oil used for cooling of the motor 6 is discharged out of the motor chamber 20 through the liquid discharging port 66. The oil is recovered through the liquid discharging path 92 into the liquid recovering part 71.

Oil flowing through the center hole 33, which serves as a motor shaft cooling part, cools the motor shaft 31, and the thus cooled motor shaft 31 in turn circumferentially cools the rotor 6*a*, which is fixed in close contact to the motor shaft 31. At the same time, oil flowing through the center hole 33, the multiple flange communication holes 27*a*, the liquid guide hole 21*c*, and the multiple liquid outlet holes 21*d* flows circumferentially through the outlet openings 21*f* into the motor chamber 20 on the rotor side, whereby the stator 6*b* is cooled circumferentially. That is, oil flowing through the motor shaft 31 cools both the rotor 6*a* and the stator 6*b* of the motor 6, whereby the motor 6 is cooled from inside. The motor 6 for rotationally driving the screw rotor 3 are thus cooled from inside, whereby the motor 6 can be cooled effectively.

As shown in FIG. 1 or 2, the bearing liquid discharging path 91, the liquid discharging path 92, the liquid discharging path 93, and the liquid discharging path 94 merge into the liquid discharging path 90. The liquid discharging path 90 is connected to the liquid recovering part 71 for recovering oil. A liquid cooler 72 (oil cooler) for cooling recovered oil is provided on the downstream side of the liquid recovering part 71. A liquid pump 73 (oil pump) is connected to the downstream side of the liquid cooler 72. A liquid supplying path 80 (oil supplying path) for supplying oil therethrough to a liquid supply target (oil supply target) is connected to the downstream side of the liquid pump 73 (oil pump). The liquid supply target (oil supply target) is the rotor bearing part 11, the intermediate bearing parts 12, 16, the motor bearing part 13, etc. In this embodiment, oil is also supplied as coolant into the motor chamber 20, the cooling jacket 8, and the center hole 33 of the motor shaft 31. This causes the liquid supplying path 80 to be branched into the bearing liquid supplying path 81, the intermediate liquid supplying path 82, the liquid supplying path 83, the liquid supplying path 84, the liquid supplying path 85, and the liquid supplying path 86. The liquid supplying paths 81, 82, 83, 84, 85, 86 are in communication, respectively, with the rotor bearing oil supplying port (not shown), the intermediate liquid supplying port 64, the liquid supplying port 65 on the rotor side, the liquid supplying port 67, the shaft liquid supplying port 69, and the liquid supplying port 77 on the anti-rotor side. Oil is therefore supplied in the compressor body 2 and the motor 6 to each liquid supply target that requires lubrication and cooling, used for lubrication and cooling of each liquid supply target, and then recovered into the liquid recovering part 71 and cooled in the liquid cooler 72, repeatedly. Oil is thus used in a manner circulating through the screw compressor 1.

Oil flowing through the center hole 33 of the motor shaft 31 and oil flowing through the cooling passage 8*b* of the cooling jacket 8 can thus cool the motor 6 effectively from inside and outside of the motor 6, whereby the motor output can be made less likely to decrease with respect to input power.

Since oil serves also as coolant, the liquid recovering part 71, 101, the liquid cooler 72, 102, and the liquid pump 73, 103 can be shared, whereby the configuration for coolant (oil) supply and discharge can be simplified.

As described heretofore, the motor casing 5 is attached to the discharge side of the rotor casing 4, and the motor shaft 31 of the motor 6 exists in an extending manner on the discharge side of the rotor casing 4. The discharge side of the rotor casing 4 is likely to have a high temperature through gas compression by the screw rotor 3, and the male rotor shaft 21 and the motor shaft 31 are likely to have a higher temperature. The male rotor shaft 21 and the motor shaft 31 can be cooled with oil not to have an increased temperature.

In the aspect shown in FIG. 1, for example, the key 41 is fitted into the key groove 42 with the connection end portion 24 of the male rotor shaft 21 having a smaller diameter being inserted in the connection hole 32 of the motor shaft 31 having a larger diameter, whereby the motor shaft 31 and the male rotor shaft 21 is connected integrally. The liquid outlet holes 21*d* are then provided in the male rotor shaft 21 having a smaller diameter. However, another aspect may be employed in which the key 41 is fitted into the key groove 42 with the motor shaft 31 having a smaller diameter being inserted in the male rotor shaft 21 having a larger diameter, whereby the motor shaft 31 and the male rotor shaft 21 is connected integrally. In this aspect, the multiple outlet openings 21*f* and liquid outlet holes 21*d* are provided in the motor shaft 31 having a smaller diameter.

Second Embodiment

Figure 6:
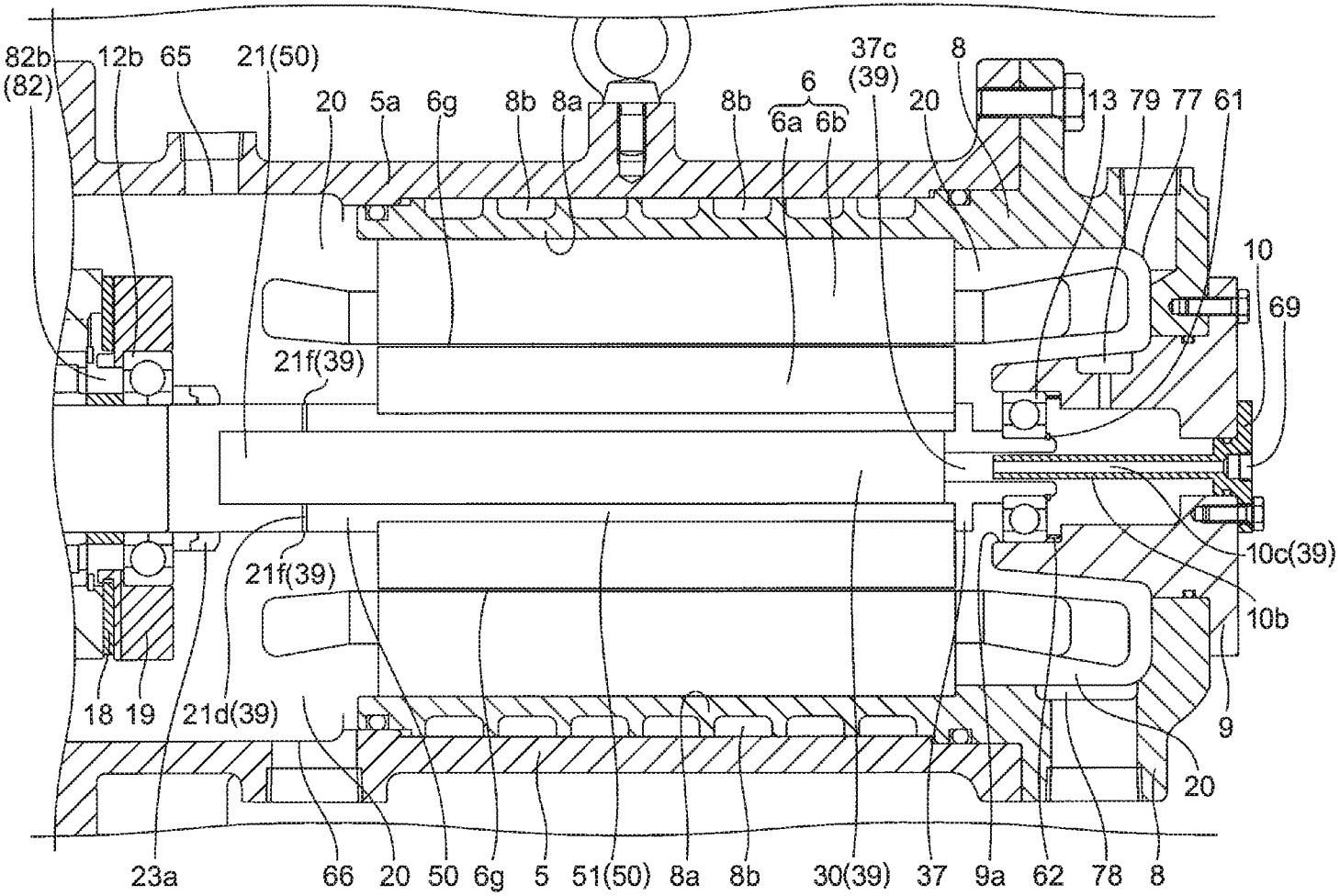
FIG. 6 is a partial cross-sectional view conceptually showing a motor chamber in a screw compressor according to a second embodiment of the present invention.

Next will be described a second embodiment of the present invention with reference to FIG. 6. In the second embodiment, components having the same functions as those in the above-described first embodiment are designated by the same reference numerals to omit redundant description.

In the screw compressor 1 according to the second embodiment, a motor side end portion 51 is included on the motor 6 side of the male rotor shaft 21, so that the male rotor shaft 21 and the motor side end portion 51 are composed of a single shaft body, that is, a rotary shaft 50. Like the motor shaft 31 in the second embodiment, the rotor 6*a* is attached to the outer peripheral surface of the motor side end portion 51.

The motor 6 side of the male rotor shaft 21 exists in an extending manner from a portion of the locking nut 23*a* on the motor 6 side to the bearing support 37 supported on the motor bearing part 13 to form the motor side end portion 51. A cooling hole 30 serving as a rotor cooling part is formed within the motor side end portion 51, which is the site of the rotary shaft 50 where the rotor 6*a* is positioned. The cooling hole 30 is a cavity through which coolant supplied through the motor shaft liquid supplying member (shaft liquid supplying part) 10 and the bearing support 37 (shaft liquid supplying part) flows. Coolant flowing through the cooling hole 30 cools the motor side end portion 51. The cooling hole 30 extends in the axial direction of the rotary shaft 50 to provide communication between the end face opening of the bearing support 37 and the multiple liquid outlet holes 21*d*. A portion of the protruding portion 10*b* of the motor shaft liquid supplying member 10 is inserted through the insertion hole 37*c* of the bearing support 37 such that an end portion of the protruding portion 10*b* overlaps the insertion hole 37*c* in the axial direction. Communication through the liquid introduction hole 10*c*, the insertion hole 37*c*, the cooling hole 30, and the multiple liquid outlet holes 21*d* then forms the motor shaft communication part 39.

With the arrangement above, coolant (oil in this embodiment) supplied through the shaft liquid supplying port 69 that is connected with the shaft liquid supplying path 85 flows through the cooling hole 30, which is formed in the motor side end portion 51 of the rotary shaft 50. Oil flowing through the cooling hole 30 cools the motor side end portion 51 of the rotary shaft 50 and further cools the rotor 6*a* circumferentially from inside (within the motor).

Oil flowing through the cooling hole 30 and used for circumferential cooling of the rotor 6*a* of the motor 6 from inside flows into the motor chamber 20 on the rotor side through each outlet opening 21*f* of the multiple liquid outlet holes 21*d* that move in the circumferential direction with the rotation of the rotary shaft 50. Oil flowing out through each outlet opening 21*f* adheres circumferentially to the stator 6*b* to cool the stator 6*b* circumferentially from within the motor chamber 20. Oil used for cooling of the motor 6 is discharged out of the motor chamber 20 through the liquid discharging port 66. The oil is recovered through the liquid discharging path 92 into the liquid recovering part 71.

Coolant (oil) flowing through the cooling hole 30, which serves as a rotor cooling part, cools the motor side end portion 51 of the rotary shaft 50, and the thus cooled rotary shaft 50 in turn circumferentially cools the rotor 6*a*, which is fixed in close contact to the rotary shaft 50. At the same time, oil flowing through the cooling hole 30 and the multiple liquid outlet holes 21*d* flows circumferentially through the outlet openings 21*f* into the motor chamber 20 on the rotor side, whereby the stator 6*b* is cooled circumferentially. That is, oil flowing through the rotary shaft 50 cools both the rotor 6*a* and the stator 6*b* of the motor 6, whereby the motor 6 is cooled from inside (within the motor chamber 20). The motor 6 for rotationally driving the screw rotor 3 are thus cooled from inside, whereby the motor can be cooled effectively.

Third Embodiment

Figure 7:
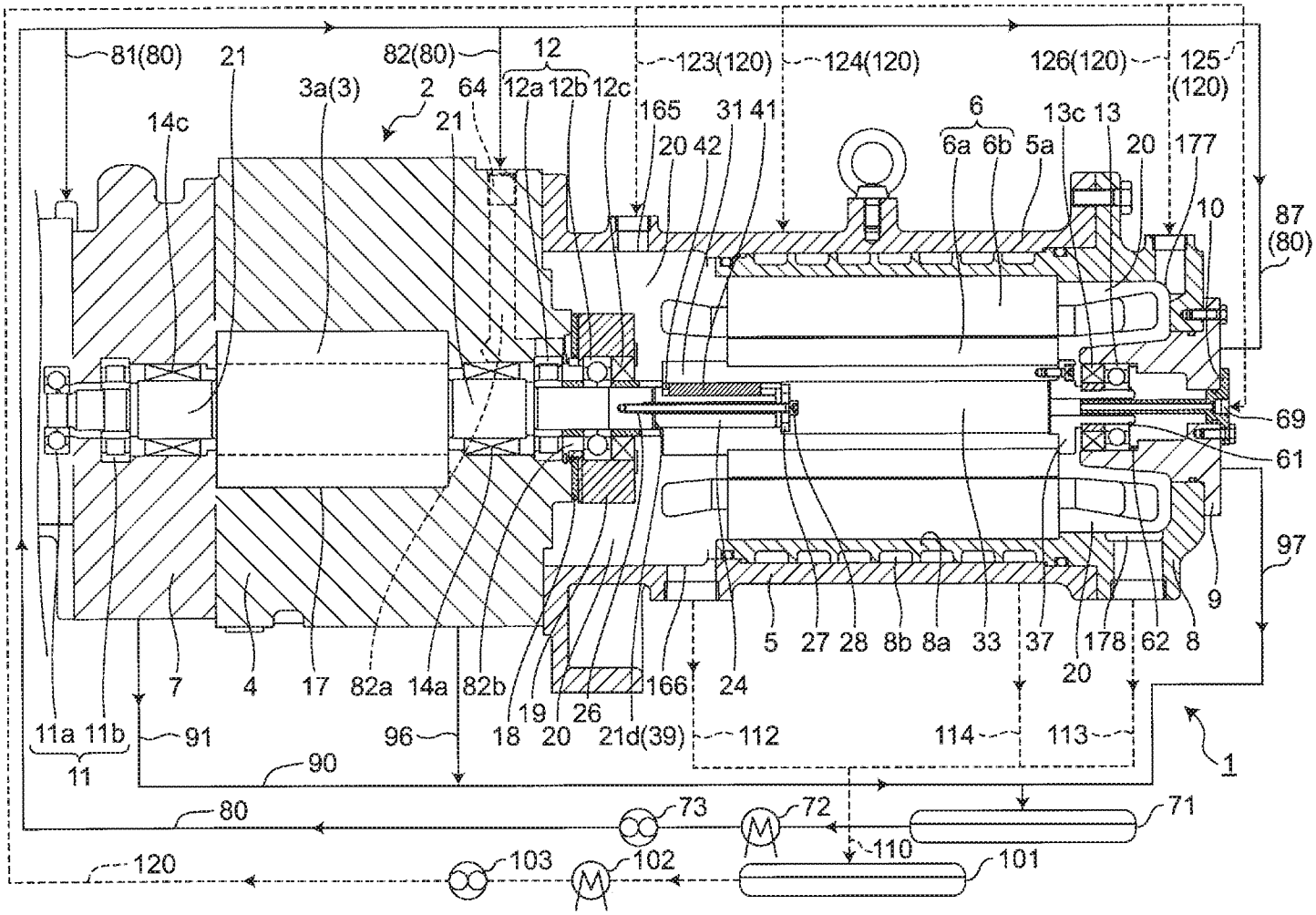
FIG. 7 is a vertical cross-sectional view conceptually showing a screw compressor according to a third embodiment of the present invention.

Next will be described a third embodiment of the present invention with reference to FIG. 7. In the third embodiment, components having the same functions as those in the above-described first embodiment are designated by the same reference numerals to omit redundant description.

The screw compressor 1 according to the third embodiment is characterized in that as coolant, oil is used for lubrication and cooling of the bearing parts 11, 12, 13 in the compressor body 2 and the motor 6, while cooling water is used for cooling of the motor 6. Here, cooling water used for cooling of the motor 6 is aqueous liquid other than oil, such as pure water or aqueous solution containing, for example, rust inhibitor and antifreeze solution.

The screw compressor 1 according to the third embodiment includes a liquid supplying path 80 (oil supplying path) and a liquid discharging path 90 (oil discharging path) through which oil circulates for lubrication and cooling of the bearing parts 11, 12, 13 in the compressor body 2 and the motor 6. At the same time, the screw compressor 1 according to the third embodiment includes a liquid supplying path 120 (water supplying path) and a liquid discharging path 110

(water discharging path) through which cooling water circulates for cooling of the motor 6.

The liquid supplying path 80 is a low path on the downstream side of the liquid recovering part 71 (oil recovering pat) and branched into the bearing liquid supplying path 81 (bearing oil supplying path), the intermediate liquid supplying path 82 (intermediate oil supplying path), and the motor bearing liquid supplying path 87 (motor bearing oil supplying path) on the downstream side of the liquid cooler 72 (oil cooler) and the liquid pump 73 (oil pump). The bearing liquid supplying path 81 (bearing oil supplying path), the intermediate liquid supplying path 82 (intermediate oil supplying path), and the motor bearing liquid supplying path 87 (motor bearing oil supplying path) are in communication, respectively, with the rotor bearing liquid supplying port (rotor bearing oil supplying port), the intermediate liquid supplying port 64 (intermediate oil supplying port), and the motor bearing liquid supplying port (motor bearing oil supplying port). In a flow path on the upstream side of the liquid recovering part 71, the bearing liquid discharging path 91, and intermediate oil discharging path 96, and a motor bearing oil discharging path 97 merge into the liquid discharging path 90.

The liquid supplying path 120 is a flow path on the downstream side of the liquid recovering part 101 (water recovering part). The liquid supplying path 120 is branched into a motor chamber liquid supplying path 123 (motor chamber water supplying path) on the rotor side with respect to the rotor 6*a*, a jacket liquid supplying path 124 (jacket water supplying path), a motor chamber liquid supplying path 126 (motor chamber water supplying path) on the anti-rotor side with respect to the rotor 6*a*, and a shaft liquid supplying path 125 (shaft water supplying path) on the downstream side of the liquid cooler 102 (water cooler) and the liquid pump 103 (water pump). The motor chamber liquid supplying path 123, the jacket liquid supplying path 124, the motor chamber liquid supplying path 126, and the shaft liquid supplying path 125 are in communication, respectively, with a motor chamber liquid supplying port 165 (motor chamber water supplying port), a jacket liquid supplying port (not shown; corresponding to the jacket liquid supplying port 67 shown in FIG. 1), a motor chamber liquid supplying port 177 (motor chamber water supplying port), and the shaft liquid supplying port 69. The liquid discharging path 110 (water discharging path) is a flow path on the upstream side of the liquid recovering part 101. An intermediate liquid discharging path 112 (motor chamber water discharging path), a jacket liquid discharging path 114 (jacket water discharging path), and a motor chamber liquid discharging path 113 (motor chamber water discharging path) on the anti-rotor side with respect to the rotor 6*a* merge into the liquid discharging path 110. The intermediate liquid discharging path 112, the jacket liquid discharging path 114, and the motor chamber liquid discharging path 113 on the anti-rotor side are in communication, respectively, with a liquid discharging port 166, a jacket liquid discharging port (not shown; corresponding to the jacket liquid discharging port 68 in the first embodiment), and a liquid discharging port 178 provided on the anti-rotor side with respect to the rotor 6*a*.

Figure 8:
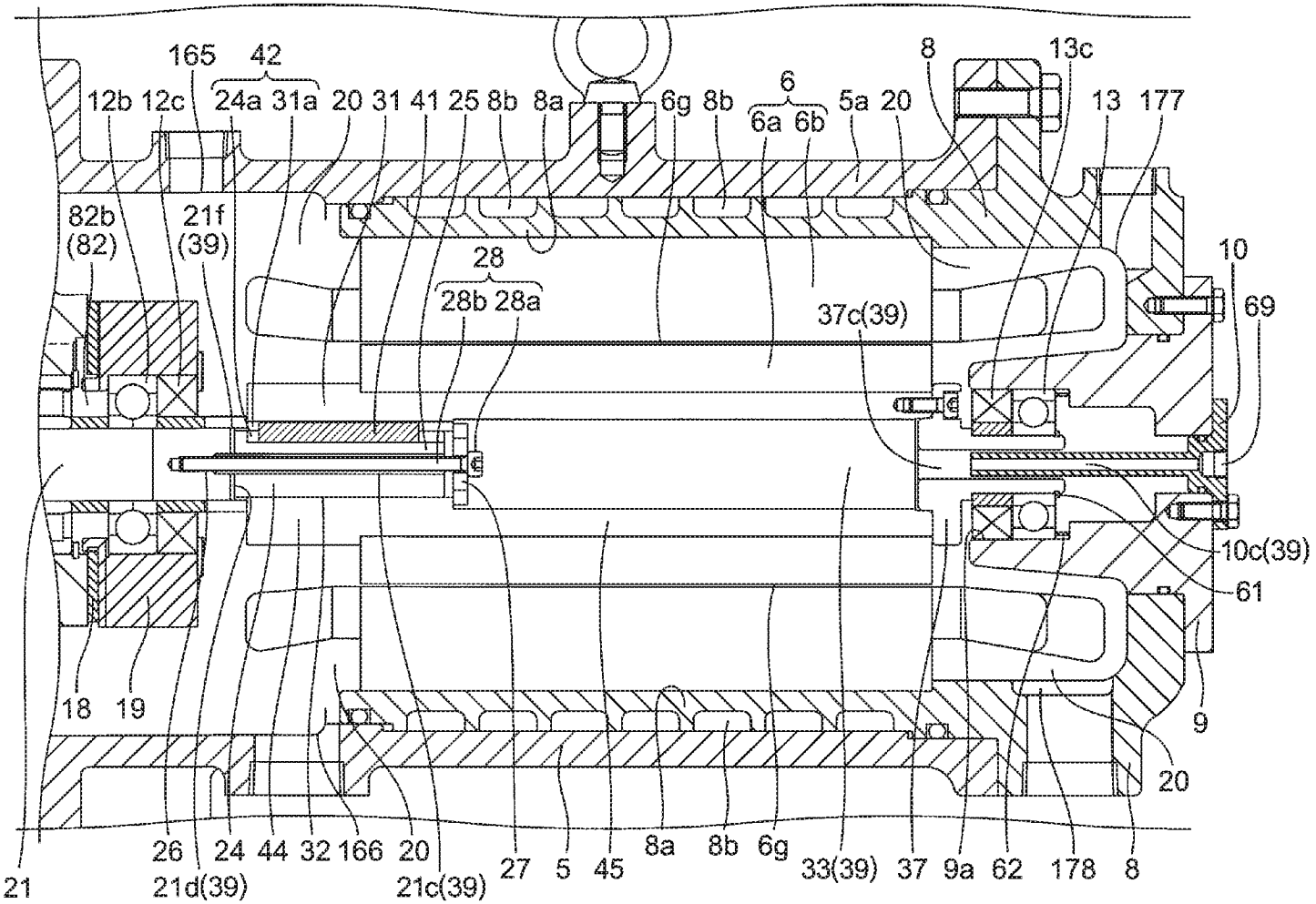
FIG. 8 is a partial cross-sectional view of a motor chamber in the screw compressor shown in FIG. 7.

As shown in FIG. 8, communication through the liquid introduction hole 10*c*, the insertion hole 37*c*, the center hole 33, the multiple flange communication holes 27*a*, the liquid guide hole 21*c*, and the multiple liquid outlet holes 21*d* forms the motor shaft communication part 39. With this arrangement, cooling water supplied through the shaft liquid supplying port 69 in communication with the shaft liquid supplying path 125 flows through the center hole 33, which is formed in the motor shaft 31, to cool the motor shaft 31 from inside (interior) thereof. Cooling from inside (within) the motor shaft 31 allows the rotor 6*a* to be cooled circumferentially from inside (within the motor 6).

Cooling water flowing through the center hole 33 and used for circumferential cooling of the rotor 6*a* of the motor 6 from inside (interior) flows into the motor chamber 20 on the rotor side through the multiple liquid outlet holes 21*d* that move in the circumferential direction with the rotation of the motor shaft 31. Cooling water flowing out through the multiple liquid outlet holes 21*d* adheres circumferentially to the stator 6*b* to cool the stator 6*b* circumferentially from within the motor chamber 20. Cooling water used for cooling of the motor 6 is discharged out of the motor chamber 20 through the liquid discharging port 66. The cooling water is recovered through the intermediate liquid discharging path 112 into the liquid recovering part 101.

Cooling water flowing through the center hole 33, which serves as a motor shaft cooling part, cools the motor shaft 31 circumferentially, and the thus cooled motor shaft 31 in turn cools the rotor 6*a*, which is fixed in close contact to the motor shaft 31. At the same time, coolant flowing through the center hole 33, the multiple flange communication holes 27*a*, the liquid guide hole 21*c*, and the multiple liquid outlet holes 21*d* flows circumferentially through the outlet openings 21*f* into the motor chamber 20 on the rotor side, whereby the stator 6*b* is cooled circumferentially. That is, cooling water flowing through the motor shaft 31 cools both the rotor 6*a* and the stator 6*b* of the motor 6, whereby the motor 6 is cooled from inside. The motor 6 for rotationally driving the screw rotor 3 are thus cooled from inside, whereby the motor can be cooled effectively.

At the same time, cooling water supplied through the jacket liquid supplying port (not shown) in communication with the jacket liquid supplying path 124 flows through the cooling passage 8*b* of the cooling jacket 8 mounted on the inner surface of the motor casing body 5*a* to cool the stator 6*b* from outside.

Cooling water flowing through the center hole 33 of the motor shaft 31 and cooling water flowing through the cooling passage 8*b* of the cooling jacket 8 can thus cool the motor 6 effectively from inside and outside of the motor 6, whereby the motor output can be made less likely to decrease with respect to input power.

Cooling water used to cool the motor 6 from inside exists within the motor chamber 20. On the other hand, oil is used for lubrication and cooling of the bearing parts 11, 12, 13 in the compressor body 2 and the motor 6. An intermediate shaft sealing part 12*c* is provided to prevent cooling water and oil from mixing between the intermediate bearing part 12 and the motor chamber 20. A motor side shaft sealing part 13*c* is also provided to prevent cooling water and oil from mixing between the motor bearing part 13 and the motor chamber 20. It is noted that a seal member (seal ring) may be provided in a gap formed by inserting a portion of the protruding portion 10*b* of the motor shaft liquid supplying member 10 through the insertion hole 37*c*. This arrangement can prevent oil and cooling water from mixing without limiting the gap to have a very small size.

The intermediate shaft sealing part 12*c* is provided on the motor 6 side of the thrust bearing 12*b* of the intermediate bearing part 12. The position of the inner race of the thrust bearing 12*b* is fixed with respect to the male rotor shaft 21 by a sleeve arranged in a manner interposed between the inner race of the thrust bearing 12*b* and the intermediate shaft sealing part 12*c*. The motor side shaft sealing part 13*c* is also provided on the motor 6 side of the motor bearing part 13. The position of the inner race of the motor bearing part 13 is fixed with respect to the bearing support 37 by a sleeve arranged in a manner interposed between the inner race of the motor bearing part 13 and the motor side shaft sealing part 13*c*.

The intermediate shaft sealing part 12*c* includes, for example, a viscoseal as an oil seal and a viscoseal seal as a cooling water seal. The viscoseals provided on the thrust bearing 12*b* side prevent oil from flowing into the motor chamber 20. The viscoseals provided on the motor 6 side prevent cooling water from flowing into the thrust bearing 12*b*. Similarly, the motor side shaft sealing part 13*c* also includes, for example, a viscoseal as an oil seal and a viscoseal seal as a cooling water seal.

The intermediate shaft sealing part 12*c* and the motor side shaft sealing part 13*c* can thus prevent oil and cooling water from mixing, whereby the liquid recovering part 71 and the liquid recovering part 101 can separately recover oil and cooling water, respectively. The recovered oil is used circulating through the liquid supplying path 80 and the liquid discharging path 90. The recovered cooling water is used circulating through the liquid supplying path 120 and the liquid discharging path 110.

It is noted that if the cooling water is pure water, a non-circulative aspect may be employed in which water discharged from the liquid discharging path 110 is discarded without being used circulating through the liquid supplying path 120 and the liquid discharging path 110 and new water is supplied from the liquid supplying path 120.

It is noted that another aspect may be employed in which an oil water separator for separating oil from oil-mixed cooling water is disposed on the downstream side of a single liquid discharging path formed by merging the liquid discharging path 90 and the liquid discharging path 110. In this case, oil and cooling water separated through the oil water separator are recovered, respectively, into the liquid recovering part 71 (oil recovering part) and the liquid recovering part 101 (water recovering part) and then supplied to each oil supply target and each water supply target through the liquid supplying path 80 and the liquid supplying path 120 for circulative use. In accordance with this aspect, the liquid discharging path can be simplified.

It is noted that the rotor shaft 21 of the screw rotor 3 and the motor shaft 31 of the motor 6 may be arranged separately as described in the first embodiment and/or that a motor side end portion 51 may be included on the motor 6 side of the male rotor shaft 21, so that the male rotor shaft 21 and the motor side end portion 51 are composed of a single shaft body, that is, a rotary shaft 50 as described in the second embodiment.

The liquid recovering part 71 is only required to be a space for at least recovering oil discharged out of the motor chamber 20, though not described in detail in the embodiments above. For example, the liquid recovering part 71 may be formed as an oil tank installed separately on the outside of the motor chamber 20 or a structure integral with the motor casing 5. Similarly, the liquid recovering part 101 is only required to be a space for at least recovering cooling water discharged out of the motor chamber 20. For example, the liquid recovering part 101 may be formed as a water tank installed separately on the outside of the motor chamber 20 or a structure integral with the motor casing 5.

While in the above-described first and third embodiments, the key 41 is used as a coupling member for integrally coupling the motor shaft 31 and the male rotor shaft 21, a tapered ring (referred to also as locking element) may be used as such a coupling member. It is noted that the tapered ring connects the motor shaft 31 and the male rotor shaft 21 through the use of a friction force occurring on the peripheral surface of a ring arranged in a mounting space between the motor shaft 31 and the male rotor shaft 21. The tapered ring is formed by combining a wedge-shaped inner race that provides one inclined surface and a wedge-shaped outer race that provides the other inclined surface to be engaged with the one inclined surface. Also, the configuration of the coupling member is not limited as long as satisfying a desired specification for the transmission torque and the shaft rotating speed.

Also, the configuration of the rotor bearing part 11, the intermediate bearing part 12, and the motor bearing part 13 and the configuration of the shaft sealing parts 14*a*, 14*b*, 14*c*, 14*d*, 12*c*, 13*c* are not limited to the above-described embodiments. In addition to an oil-free one to be driven rotationally at a high speed of about 20000 rpm, for example, the screw compressor 1 having the above-described cooling structure may employ an oil-cooled one to be driven rotationally at a low speed of about 3000 rpm with cooling oil introduced into the rotor chamber 17.

While a viscoseal is exemplified for each of the intermediate shaft sealing part 12*c* and the motor side shaft sealing part 13*c*, a lip seal may be used appropriately in view of, for example, the shaft rotating speed at each shaft sealing part.

Also, the cooling jacket 8 may not be included and the cooling passage 8*b*, through which coolant flows for cooling of the stator 6*b* of the motor 6, may be formed in the motor casing body 5*a*. In this case, the stator 6*b* is attached directly to the inner wall surface of the motor casing body 5*a*.

It is noted that "rotor side" as used herein for "the motor chamber 20 on the rotor side and the liquid supplying port 65 on the rotor side" mean not that they are on the rotor 6*a* side of the motor 6 with respect to a reference position, but that they are on the screw rotor 3 side of the compressor body 2 with respect to a reference position.

As is clear from the description above, the screw compressor 1 according to the present invention includes the compressor body 2 in which the screw rotor 3 is accommodated in the rotor casing 4; the motor 6 in which the rotor 6*a* and the stator 6*b* are accommodated in the motor chamber 20 of the motor casing 5, the motor 6 arranged to rotationally drive the rotor shaft 21 of the screw rotor 3 through the motor shaft 31 fixed to the rotor 6*a*; the shaft liquid supplying part 10, 37 provided on the anti-rotor side of the motor shaft 31 to supply coolant; the motor shaft cooling part 33 which is a cavity extending in the axial direction within the motor shaft 31, the motor shaft cooling part 33 arranged to cool the motor shaft 31 with coolant supplied through the shaft liquid supplying part 10, 37 flowing through the cavity; and the liquid outlet part 21*d* positioned on the rotor side of the motor shaft 31 or the motor 6 side of the rotor shaft 21 and extending radially inward from the outlet openings 21*f* formed in the outer surface of the motor shaft 31 or the rotor shaft 21 to be connected fluidically with the motor shaft cooling part 33.

In accordance with the arrangement above, coolant flowing through the motor shaft cooling part 33 cools the motor shaft 31. Cooling from within the motor shaft 31 allows the rotor 6*a* fixed to the motor shaft 31 to be cooled circumferentially. At the same time, coolant outlet through the outlet openings 21*f*, which move circumferentially with the rotation of the motor shaft 31, allows the stator 6*b* to be cooled circumferentially within the motor chamber 20. The rotor 6*a* and the stator 6*b* of the motor 6 for rotationally driving the screw rotor 3 are thus cooled circumferentially from within the motor 6, whereby the motor 6 can be cooled effectively.

The discharge side of the rotor casing 4 is connected to the motor casing 5, the rotor shaft 21 is connected coaxially to the motor shaft 31, a rotor shaft cooling part 21*c* for use in connecting the rotor shaft 21 and the motor shaft 31 is further included which is a cavity provided on the motor 6 side of the rotor shaft 21 and extending in the axial direction within the rotor shaft 21, and the rotor shaft cooling part 21*c* is connected fluidically with the motor shaft cooling part 33 and the liquid outlet part 21*d*. With this arrangement, while the rotor shaft 21 has a high temperature through gas compression on the discharge side of the rotor casing 4, the rotor shaft 21 and the motor shaft 31 cannot have an increased temperature because the rotor shaft 21 includes the rotor shaft cooling part 21*c*.

The screw compressor 1 according to the present invention also includes the compressor body 2 in which the screw rotor 3 is accommodated in the rotor casing 4; the motor 6 in which the rotor 6*a* and the stator 6*b* are accommodated in the motor chamber 20 of the motor casing 5, the motor 6 arranged to rotationally drive the screw rotor 3 through the rotary shaft fixed to the rotor 6*a*; the shaft liquid supplying part 10 provided on the motor side end portion 51 of the rotary shaft 50 to supply coolant; the rotor cooling part 30 which is a cavity provided within the rotary shaft 50 at the site where the rotor 6*a* is positioned, the rotor cooling part 30 arranged to cool the rotor 6*a* with coolant supplied through the shaft liquid supplying part 10 flowing through the cavity; and the liquid outlet part 21*d* positioned between the screw rotor 3 and the rotor 6*a* in the rotary shaft 50, having the outlet openings 21*f* provided in the outer surface of the rotary shaft 50 in a manner opened into the motor chamber 20, and extending radially inward from the outlet openings 21*f* to be connected fluidically with the rotor cooling part 30.

In accordance with the arrangement above, coolant flowing through the rotor cooling part 30 provided within the rotary shaft 50 at the site where the rotor 6*a* is positioned cools the rotary shaft 50 circumferentially. Cooling from within the rotary shaft 50 allows the rotor 6*a* fixed to the rotary shaft 50 to be cooled circumferentially. At the same time, coolant outlet in the circumferential direction of the rotary shaft 50 through the outlet openings 21*f*, which move circumferentially with the rotation of the rotary shaft 50, allows the stator 6*b* to be cooled circumferentially within the motor chamber 20. The stator 6*b* and the rotor 6*a* of the motor 6 for rotationally driving the screw rotor 3 are thus cooled circumferentially from inside directly, whereby the motor 6 can be cooled effectively.

In addition to the above-described features, the present invention may include the following features.

That is, the screw compressor 1 includes the liquid cooler 72, 102 for cooling coolant used for cooling of the motor 6, the liquid discharging path 90, 110 for suppling coolant discharged out of the liquid discharging part 66, 78 provided in the motor casing 5 therethrough to the liquid cooler 72, 102, the liquid supplying path 80, 120 for supplying coolant cooled in the liquid cooler 72, 102 therethrough to a liquid supply target, and the shaft liquid supplying path 85, 125 branched from the liquid supplying path 80, 120 for supplying therethrough into the shaft liquid supplying part 10, 37. This arrangement allows the cooled coolant to be circulated and used.

The liquid supplying path 80, 120 is branched into the jacket liquid supplying path 84, 124, which is in turn connected fluidically with the cooling jacket 8 for cooling the stator 6*b* of the motor 6, and the jacket liquid discharging path 94, 114 connected fluidically on the downstream side of the cooling jacket 8 merges into the liquid discharging path 90, 110. In accordance with this arrangement, the coolant cools the rotor 6*a* of the motor 6 and the interior of the motor chamber 20 as well as the cooling jacket 8 and the stator 6*b* of the motor 6. That is, both the stator and the rotor of the motor are cooled.

The liquid recovering part 71, 101 for storing coolant used for cooling of the motor 6 is provided on the downstream side of the cooling jacket 8. In accordance with this arrangement, there is no need to retain coolant within the motor chamber 20 even if the cooling jacket 8 may be used that requires a relatively large amount of coolant, which can reduce the loss of coolant agitation by the rotor 6*a* of the motor 6.

The motor chamber liquid supplying port 65, 77 for supplying coolant therethrough into the motor chamber 20 is disposed in an upper portion of the motor chamber 20. Since this arrangement causes coolant to be supplied through the motor chamber liquid supplying port 65, 77 into the upper portion of the motor chamber 20, the motor chamber 20 can be cooled more effectively.

The coolant is oil for lubricating the bearing parts 11, 12, 13 provided in at least one of the motor 6 and the compressor body 2. In accordance with this arrangement, since oil serves also as coolant, the liquid recovering part 71, 101, the liquid cooler 72, 102, and the liquid pump 73, 103 can be shared, whereby the configuration for oil (coolant) supply and discharge can be simplified.

EXPLANATION OF REFERENCE NUMERALS

1 Screw compressor (oil-free screw compressor)
2 Compressor body
3 Screw rotor
3*a* Male rotor
3*b* Female rotor
4 Rotor casing
5 Motor casing
5*a* Motor casing body
6 Motor
6*a* Rotor
6*b* Stator
6*g* Air gap
7 Bearing casing
8 Cooling jacket
9 Cover
10 Motor shaft liquid supplying member (shaft liquid supplying part)
10*c* Liquid introduction hole
11 Rotor bearing part (bearing part)
12 Intermediate bearing part (bearing part)
12*c* Intermediate shaft sealing part
13 Motor bearing part (bearing part)
13*c* Motor side shaft sealing part
14*a* Intermediate shaft sealing part
17 Rotor chamber
20 Motor chamber
21 Male rotor shaft (rotor shaft)
21*c* Liquid guide hole (rotor shaft cooling part)
21*d* Liquid outlet hole (liquid outlet part)
21*f* Outlet opening
22 Female rotor shaft (rotor shaft)
26 Screw hole
27 Fastening flange
28 Fastening bolt (fastening member)

30 Cooling hole (rotor cooling part)
31 Motor shaft
33 Center hole (motor shaft cooling part)
37 Bearing support (shaft liquid supplying part)
39 Motor shaft communication part
41 Key (coupling member)
42 Key groove
50 Rotary shaft
51 Motor side end portion
54 Intermediate communication part
64 Intermediate liquid supplying port (intermediate oil supplying port)
65 Motor chamber liquid supplying port (motor chamber oil supplying port)
66 Motor chamber liquid discharging port (motor chamber oil discharging port; liquid discharging part)
67 Jacket liquid supplying port
68 Jacket liquid discharging port
69 Motor shaft liquid supplying port
71 Liquid recovering part (oil recovering part)
72 Liquid cooler (oil cooler)
73 Liquid pump (oil pump)
77 Motor chamber liquid supplying port (motor chamber oil supplying port)
78 Motor chamber liquid discharging port (motor chamber oil discharging port; liquid discharging part)
80 Liquid supplying path (oil supplying path)
81 Bearing liquid supplying path (bearing oil supplying path)
82 Liquid supplying path (oil supplying path)
82*a* Intermediate liquid supplying hole (intermediate oil supplying hole)
82*b* Communication space
83 Motor chamber liquid supplying path (motor chamber oil supplying path)
84 Jacket liquid supplying path
85 Shaft liquid supplying path
86 Motor chamber liquid supplying path (motor chamber oil supplying path)
90 Liquid discharging path (oil discharging path)
91 Bearing liquid discharging path (bearing oil discharging path)
92 Motor chamber liquid discharging path (motor chamber oil discharging path)
93 Motor chamber liquid discharging path (motor chamber oil discharging path)
94 Jacket liquid discharging path (jacket oil discharging path; liquid discharging path)
96 Intermediate oil discharging path
101 Liquid recovering part (water recovering part)
102 Liquid cooler (water cooler)
103 Liquid pump (water pump)
110 Liquid discharging path (water discharging path)
112 Intermediate liquid discharging path (motor chamber water discharging path)
113 Motor chamber liquid discharging path (motor chamber water discharging path)
114 Jacket liquid discharging path (jacket water discharging path)
120 Liquid supplying path (water supplying path)
123 Motor chamber liquid supplying path (motor chamber water supplying path)
124 Jacket liquid supplying path (jacket water supplying path)
125 Shaft liquid supplying path (shaft water supplying path)
126 Motor chamber liquid supplying path (motor chamber water supplying path)
165 Motor chamber liquid supplying port (motor chamber water supplying port)
166 Motor chamber liquid discharging port (motor chamber water discharging port; liquid discharging port)
177 Motor chamber liquid supplying port (motor chamber water supplying port)
178 Motor chamber liquid discharging port (motor chamber water discharging port; liquid discharging port)

The invention claimed is:

1. A screw compressor comprising:

a compressor body in which a screw rotor is accommodated in a rotor casing;

a motor in which a rotor and a stator are accommodated in a motor chamber of a motor casing, the motor arranged to rotationally drive a rotor shaft of the screw rotor through a motor shaft fixed to the rotor;

a shaft liquid supplying port provided on an anti-rotor side of the motor shaft to supply coolant;

a motor shaft cooling part which is a cavity extending in the axial direction within the motor shaft, the motor shaft cooling part arranged to cool the motor shaft with coolant supplied through the shaft liquid supplying port flowing through the cavity;

a rotor shaft cooling part which is a cavity extending in the axial direction within the rotor shaft, the rotor shaft cooling part arranged to cool the rotor shaft with the coolant supplied through the motor shaft cooling part; and a liquid outlet part positioned on a rotor side of the motor shaft or a motor side of the rotor shaft and extending radially inward from an outlet opening formed in an outer surface of the motor shaft or the rotor shaft to be connected fluidically with the rotor shaft cooling part and the motor shaft cooling part, wherein the outlet opening opens directly into the motor chamber;

the rotor shaft is coaxially coupled with the motor shaft;

the motor shaft cooling part includes a first region with a first inner diameter and a second region with a second inner diameter, the second inner diameter being greater than the first inner diameter; and the first region of the motor shaft cooling part is positioned to surround a portion of the rotor shaft.

2. The screw compressor according to claim 1, wherein a discharge side of the rotor casing is connected to the motor casing, and the rotor shaft cooling part is provided within a connection end portion which is used for coupling between the rotor shaft and the motor shaft, wherein the rotor shaft cooling part is connected fluidically with the motor shaft cooling part and the liquid outlet part.

3. The screw compressor according to claim 1, further comprising: a liquid cooler for cooling coolant used for cooling of the motor; a liquid discharging path for supplying coolant discharged from a liquid discharging port provided in the motor casing therethrough to the liquid cooler; a liquid supplying path for supplying coolant cooled in the liquid cooler therethrough to a liquid supply target; and a shaft liquid supplying path branched from the liquid supplying path for supplying coolant therethrough to the shaft liquid supplying port.

4. The screw compressor according to claim 3, wherein the liquid supplying path is branched into a jacket liquid supplying path, the jacket liquid supplying path is connected fluidically with a cooling jacket for cooling the stator of the motor, and a jacket liquid discharging path connected fluidically to the downstream side of the cooling jacket merges into the liquid discharging path.

5. The screw compressor according to claim 4, wherein a liquid recovering part for storing coolant used for cooling of the motor is provided on the downstream side of the cooling jacket.

6. The screw compressor according to claim 1, wherein a motor chamber liquid supplying port for supplying coolant therethrough is disposed in an upper portion of the motor chamber.

7. The screw compressor according to claim 1, wherein the coolant is oil for lubricating a bearing part provided in at least one of the motor and the compressor body.

8. The screw compressor according to claim 2, further comprising:

a liquid cooler for cooling coolant used for cooling of the motor;

a liquid discharging path for supplying coolant discharged from a liquid discharging port provided in the motor casing therethrough to the liquid cooler;

a liquid supplying path for supplying coolant cooled in the liquid cooler therethrough to a liquid supply target; and a shaft liquid supplying path branched from the liquid supplying path for supplying therethrough to the shaft liquid supplying port.

9. The screw compressor according to claim 2, wherein a motor chamber liquid supplying port for supplying coolant therethrough is disposed in an upper portion of the motor chamber.

10. The screw compressor according to claim 2, wherein the coolant is oil for lubricating a bearing part provided in at least one of the motor and the compressor body.

11. The screw compressor according to claim 1, wherein a motor side end portion of the rotor shaft is inserted into the cavity of the motor shaft cooling part, and the motor side end portion of the rotor shaft is formed with the rotor shaft cooling part and a screw hole at an end of the rotor shaft cooling part, wherein the rotor shaft and the motor shaft are fixed via a fastening bolt which has a head and a screw portion at a leading end thereof where the fastening bolt penetrates through the rotor shaft cooling part and the head engages with a part of the motor shaft in the cavity and the screw portion is screwed with the screw hole of the rotor shaft.

12. The screw compressor according to claim 11, wherein an inner diameter of the cavity of the rotor shaft cooling part is larger than an outer diameter of the fastening bolt so that an annular space is formed between the inner diameter of the cavity of the rotor shaft cooling part and the outer diameter of the fastening bolt, and the annular space is fluidically communicated with the motor shaft cooling part.

13. The screw compressor according to claim 12, wherein the liquid outlet part is fluidically communicated with the annular space.

* * * * *